US009782312B2

(12) United States Patent
Brubaker et al.

(10) Patent No.: US 9,782,312 B2
(45) Date of Patent: Oct. 10, 2017

(54) PATIENT SUPPORT

(71) Applicant: Stryker Corporation, Kalamazoo, MI (US)

(72) Inventors: Michael T. Brubaker, Vicksburg, MI (US); Stephen F. Peters, Hickory Corners, MI (US); Benoit Martel, San Jose, CA (US)

(73) Assignee: Stryker Corporation, Kalamazoo, MI (US)

( * ) Notice: Subject to any disclaimer, the term of this patent is extended or adjusted under 35 U.S.C. 154(b) by 7 days.

(21) Appl. No.: 14/472,697

(22) Filed: Aug. 29, 2014

(65) Prior Publication Data

US 2015/0059100 A1 Mar. 5, 2015

Related U.S. Application Data

(60) Provisional application No. 61/874,165, filed on Sep. 5, 2013.

(51) Int. Cl.

| | |
|---|---|
| ***A61G 7/05*** | (2006.01) |
| ***A61G 7/00*** | (2006.01) |
| ***A61G 7/057*** | (2006.01) |

(52) U.S. Cl.

CPC ..... *A61G 7/05776* (2013.01); *A61G 7/001* (2013.01); *A61G 7/05738* (2013.01); *A61G 7/05792* (2016.11); *A61G 2203/34* (2013.01); *A61G 2203/40* (2013.01)

(58) Field of Classification Search

CPC ..... A61G 7/057; A61G 7/05769; A61G 7/05776; A61G 7/05784; A61G 7/05792; A47C 27/08; A47C 27/081; A47C 27/082; A47C 27/10

See application file for complete search history.

(56) References Cited

U.S. PATENT DOCUMENTS

| | | | |
|---|---|---|---|
| D180,063 | S | 4/1957 | Burton |
| 3,192,541 | A | 7/1965 | Moore |
| 4,005,236 | A | 1/1977 | Graebe |
| 4,279,044 | A | 7/1981 | Douglas |
| 4,541,136 | A | 9/1985 | Graebe |
| 4,651,369 | A | 3/1987 | Guldager |
| 4,698,864 | A | 10/1987 | Graebe |
| 4,722,105 | A | 2/1988 | Douglas |

(Continued)

FOREIGN PATENT DOCUMENTS

| | | |
|---|---|---|
| EP | 0296689 | 12/1988 |

OTHER PUBLICATIONS

PCT International Search Report regarding Application No. PCT/US2014/050423 filed Sep. 4, 2014, a counterpart to U.S. Appl. No. 14/472,697.

(Continued)

*Primary Examiner* — Eric Kurilla

(74) *Attorney, Agent, or Firm* — Warner Norcross & Judd LLP

(57) ABSTRACT

A patient support includes a bladder layer with a plurality of bladders, a pneumatic supply system, and a plurality of tubes in fluid communication with pneumatic supply system. The tubes are coupled to and guided by the bladder layer so that the tubes and bladder layer may remain in close registry when being handled, for example, either during the assembly process or cleaning process.

21 Claims, 29 Drawing Sheets

(56) References Cited

U.S. PATENT DOCUMENTS 4,860,397 A 8/1989 Gusakov
4,864,671 A 9/1989 Evans
4,982,466 A 1/1991 Higgins et al.
5,109,560 A * 5/1992 Uetake ..... A61G 7/05784 5/713
5,163,196 A 11/1992 Graebe et al.
5,243,722 A 9/1993 Gusakov
5,304,271 A 4/1994 Gusakov
5,369,828 A 12/1994 Graebe
D355,558 S 2/1995 Graebe
5,461,741 A 10/1995 Graebe
5,502,855 A 4/1996 Graebe
5,533,220 A 7/1996 Sebag et al.
5,551,107 A 9/1996 Graebe
5,596,781 A 1/1997 Graebe
5,613,257 A 3/1997 Graebe
5,689,845 A 11/1997 Sobieralski
5,794,289 A 8/1998 Wortman et al.
5,815,864 A 10/1998 Sloop
5,888,156 A 3/1999 Cmiel et al.
5,926,883 A 7/1999 Rechin et al.
5,966,763 A 10/1999 Thomas et al.
6,079,065 A 6/2000 Luff et al.
6,145,142 A 11/2000 Rechin et al.
6,212,718 B1 * 4/2001 Stolpmann ..... A61G 7/05776 285/914
6,317,912 B1 11/2001 Graebe et al.
6,510,573 B1 1/2003 Grabe
6,560,804 B2 5/2003 Wise et al.
6,564,410 B2 5/2003 Graebe et al.
6,623,080 B2 9/2003 Clapper
6,687,936 B2 2/2004 Graebe et al.
6,687,937 B2 2/2004 Harker
6,715,171 B2 4/2004 Grabe
6,721,979 B1 4/2004 Vrzalik et al.
6,813,790 B2 11/2004 Flick et al.
6,901,617 B2 6/2005 Sprouse, II et al.
6,920,691 B2 7/2005 Ham
6,943,694 B1 9/2005 Ellis
6,986,182 B2 1/2006 Mossbeck
7,168,116 B2 1/2007 Reger et al.
7,398,573 B2 7/2008 Ellis et al.
7,406,734 B2 8/2008 Mai et al.
7,409,735 B2 8/2008 Kramer et al.
7,414,536 B2 8/2008 Call et al.
7,434,282 B2 10/2008 Fraser et al.
7,441,290 B1 * 10/2008 Flick ..... A61G 7/05715 5/615
7,444,704 B2 11/2008 Phillips et al.
7,469,436 B2 12/2008 Meyer et al.
7,513,003 B2 4/2009 Mossbeck
7,557,718 B2 7/2009 Petrosenko et al.
7,587,776 B2 9/2009 Poulos
7,657,956 B2 2/2010 Stacy et al.
7,698,765 B2 4/2010 Bobey et al.
D617,131 S 6/2010 Sprouse, II
7,832,039 B2 11/2010 Chambers et al.
7,883,478 B2 2/2011 Skinner et al.
7,921,488 B2 4/2011 King et al.
7,937,791 B2 5/2011 Meyer et al.
7,966,680 B2 6/2011 Romano et al.
7,971,300 B2 7/2011 Wilker, Jr.
8,037,563 B2 10/2011 Richards et al.
8,108,957 B2 2/2012 Richards et al.
8,752,222 B2 6/2014 Papaioannou
2005/0151410 A1 7/2005 Sprouse, II
2005/0172405 A1 * 8/2005 Menkedick ..... A61B 5/1115 5/618
2006/0112489 A1 6/2006 Bobey et al.
2007/0033738 A1 2/2007 Tu
2007/0277320 A1 12/2007 Massmann
2008/0083416 A1 4/2008 Xia et al.
2008/0289108 A1 * 11/2008 Menkedick ..... A61G 7/0528 5/610
2009/0106905 A1 4/2009 Ochi et al.
2009/0144906 A1 6/2009 Satoh et al.
2009/0217460 A1 9/2009 Bobey et al.
2010/0057169 A1 3/2010 King et al.
2010/0101026 A1 4/2010 Papaioannou
2010/0205745 A1 8/2010 Nihei et al.
2010/0205749 A1 8/2010 Huang
2010/0205750 A1 8/2010 McCausland et al.
2010/0308846 A1 12/2010 Camus
2013/0061396 A1 3/2013 Lafleche et al.

OTHER PUBLICATIONS

PCT International Written Opinion regarding Application No. PCT/US2014/050423 filed Sep. 4, 2014, a counterpart to U.S. Appl. No. 14/472,697.

* cited by examiner

PATIENT SUPPORT

CROSS-REFERENCE TO RELATED APPLICATIONS

This application claims the benefit of U.S. provisional application Ser. No. 61/874,165, entitled PATIENT SUPPORT, filed on Sep. 5, 2013, which is incorporated by reference herein in its entirety.

This application is related to U.S. utility application Ser. No. 14/019,353 filed Sep. 5, 2013, entitled PATIENT SUPPORT, U.S. utility application Ser. No. 14/308,131 filed Jun. 18, 2014, entitled PATIENT SUPPORT COVER, U.S. utility application Ser. No. 13/548,591, filed Jul. 13, 2012, entitled PATIENT/INVALID HANDLING SUPPORT; U.S. utility application Ser. No. 13/022,326, filed Feb. 7, 2011, entitled PATIENT/INVALID HANDLING SUPPORT; U.S. utility application Ser. No. 13/022,372, filed Feb. 7, 2011, entitled PATIENT/INVALID HANDLING SUPPORT; U.S. utility application Ser. No. 13/022,382, filed Feb. 7, 2011, entitled PATIENT/INVALID HANDLING SUPPORT; U.S. utility application Ser. No. 13/022,454, filed Feb. 7, 2011, entitled PATIENT/INVALID HANDLING SUPPORT; U.S. utility application Ser. No. 12/640,770 filed Dec. 17, 2009, entitled PATIENT SUPPORT; and U.S. utility application Ser. No. 12/640,643, filed Dec. 17, 2009, entitled PATIENT SUPPORT, all of which are incorporated by reference herein in their entireties.

TECHNICAL FIELD AND BACKGROUND OF THE INVENTION

The present invention generally relates to a patient support, and more particularly to a patient mattress for a hospital bed.

SUMMARY OF THE INVENTION

The present disclosure provides a mattress for supporting a patient with one or more cushioning layers that provide immersion and pressure distribution to a patient supported on the mattress, as well as a low air loss system.

In one embodiment, a patient support includes a plurality of cushioning layers arranged such that their upper cushioning layer forms a support surface for a patient. The upper cushioning layer comprises a bladder layer with a plurality of bladders with at least two zones, with each zone being configured to be separately inflatable. Located beneath the upper cushioning layer are a pneumatic supply system and a plurality of supply tubes, which are in communication with the pneumatic supply system and coupled to and guided by the bladder layer for inflating the bladders.

In one aspect, the bladder layer forms a carrier for the supply tubes. For example, the bladder layer may include a plurality of supports for coupling the supply tubes to the bladder layer. For example, the supports may comprise channels that are formed or attached at or to the bottom surface of the bladder layer. Suitable supports may be formed from patches of sheet material that are adhered or welded at or to the bottom surface of the bladder layer. For example, the bladder layer may be formed by an upper sheet and a lower sheet, which are joined together, for example, by welding, with the supports mounted to the lower sheet. For example, the supports may be adhered or welded to the lower sheet. Alternatively, an additional sheet may be provided and joined with the lower sheet, with the supports mounted to the additional sheet.

According to yet another aspect, the bladder layer may include a harness for supporting the tubes. For example, as noted, the bladder layer may be formed by an upper sheet and a lower sheet, with the harness formed by the upper sheet. Alternately, the harness may be formed by the lower sheet or both sheets.

In a further aspect, the harness comprises an extension of the respective sheet or sheets of the bladder layer, for example, in the form of a flange, which is adapted to support the supply tubes. For example, the flange may have openings through which the supply tubes may be routed or passed through and which are sized to hold the tubes in place. For example, the openings may comprise a pair of slits, which are spaced to form loops between the slits so that the loops will frictionally hold the supply tubes in place.

In another embodiment, a patient support includes a plurality of cushioning layers arranged such that their upper cushioning layer forms a support surface for a patient. The upper cushioning layer comprises a bladder layer with a plurality of bladders with at least two zones, with each zone being configured to be separately inflatable. Located beneath the upper cushioning layer is a sensing system with a plurality of sensing tubes, which are coupled to and guided by the bladder layer and coupled to the respective zones for sensing the pressure in the zones.

In one aspect, the bladder layer forms a carrier for the supply tubes. For example, the bladder layer may include a plurality of supports for coupling the sensing tubes to the bladder layer. For example, the supports may comprise channels that are formed or attached at or to the bottom surface of the bladder layer. Suitable supports may be formed from patches of sheet material that are adhered or welded at or to the bottom surface of the bladder layer. For example, the bladder layer may be formed by an upper sheet and a lower sheet, which are joined together, for example, by welding, with the supports mounted to the lower sheet. For example, the supports may be adhered or welded to the lower sheet. Alternatively, an additional sheet may be provided and joined with the lower sheet, with the supports mounted to the additional sheet.

According to yet another aspect, the bladder layer may include a harness for supporting the sensing tubes. For example, as noted, the bladder layer may be formed by an upper sheet and a lower sheet, with the harness formed by the upper sheet. Alternately, the harness may be formed by the lower sheet or both sheets.

In a further aspect, the harness comprises an extension of the respective sheet or sheets of the bladder layer, for example, in the form of a flange, which is adapted to support the sensing tubes. For example, the flange may have openings through which the sensing tubes may be routed or passed through and which are configured to hold the tubes in place. For example, the openings may comprise a pair of slits, which are spaced to form loops between the slits so that the loops can frictionally hold the sensing tubes in place.

According to yet another aspect, in any of the above patient supports, the bladder layer may include transverse openings allowing air to pass through the bladder layer to direct air flow through the at least one cushioning layer.

In any of the above supports, the patient support may include a gel layer adjacent the inflatable bladders. For example, the gel layer may interlock with adjacent bladders of the inflatable bladders.

In another aspect, each of the bladders has a hexagonal cross-section. In addition or alternately, the gel layer may include a plurality of hexagonal gel footings. For example, each of the gel footings may be disconnected from its adjacent gel footings. Optionally, each of the gel footings may be internally reinforced by a plurality of gel wall structures.

According to yet another aspect, the cushioning layers are supported on a foam crib.

In addition, the support optionally includes turning bladders positioned below the foam crib, with the foam crib including at least two hinged panels to allow turning of a patient supported on the patient support.

In another aspect, the support includes a cover and is configured to flow air through the support beneath the cover to manage moisture that may build up under the cover, which is formed from a material that prevents liquid intrusion but allows gas and moisture to flow through the cover.

For example, the foam crib may include a plurality of channels extending there through for directing air through the foam crib and into at least one of the cushioning layers. Additionally, the foam crib may support or house one or more blowers to direct air though the channels.

In another aspect, the support cover includes a mesh panel that permits air to be drawn into the cover by the blower units.

In another embodiment, a patient support includes a plurality of cushioning layers arranged such that their supporting surfaces when unloaded are generally arranged in a plane. Each cushioning layer is interlocked with each adjacent cushioning layer wherein each cushioning layer provides lateral and longitudinal support to each of its adjacent cushioning layers.

In one aspect, the cushioning layers include a bladder layer.

In another aspect, the cushioning layers include a gel layer.

According to yet another aspect, at least one of the cushioning layers includes transverse openings allowing air to pass through the at least one cushioning layer to direct air flow through the at least one cushioning layer.

In any of the above supports, the patient support may include a plurality of inflatable bladders and a gel layer adjacent the inflatable bladders. For example, the gel layer may interlock with adjacent bladders of the inflatable bladders.

In another aspect, each of the bladders has a hexagonal cross-section. In addition or alternately, the gel layer may include a plurality of hexagonal gel footings. For example, each of the gel footings may be disconnected from its adjacent gel footings. Optionally, each of the gel footings may be internally reinforced by a plurality of gel wall structures.

According to yet another aspect, the cushioning layers are supported on a foam crib.

In addition, the support optionally includes turning bladders positioned below the foam crib, with the foam crib including at least two hinged panels to allow turning of a patient supported on the patient support.

In another aspect, the support includes a cover and is configured to flow air through the support beneath the cover to manage moisture that may build up under the cover, which is formed from a material that prevents liquid intrusion but allows gas and moisture to flow through the cover.

For example, the foam crib may include a plurality of channels extending there through for directing air through the foam crib and into at least one of the cushioning layers. Additionally, the foam crib may support or house one or more blowers to direct air though the channels.

In another aspect, the support cover includes a mesh panel that permits air to be drawn into the cover by the blower units.

Accordingly, a support surface is provided the offers pressure distribution and optionally improved moisture management for a patient.

Accordingly, a support surface is provided that offers a patient with pressure distribution and optionally improved moisture management.

Before the embodiments of the invention are explained in more detail below, it is to be understood that the invention is not limited to the details of operation or to the details of construction and the arrangement of the components set forth in the following description or illustrated in the drawings. The invention may be implemented in various other embodiments and is capable of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE PREFERRED EMBODIMENT

Figure 1:
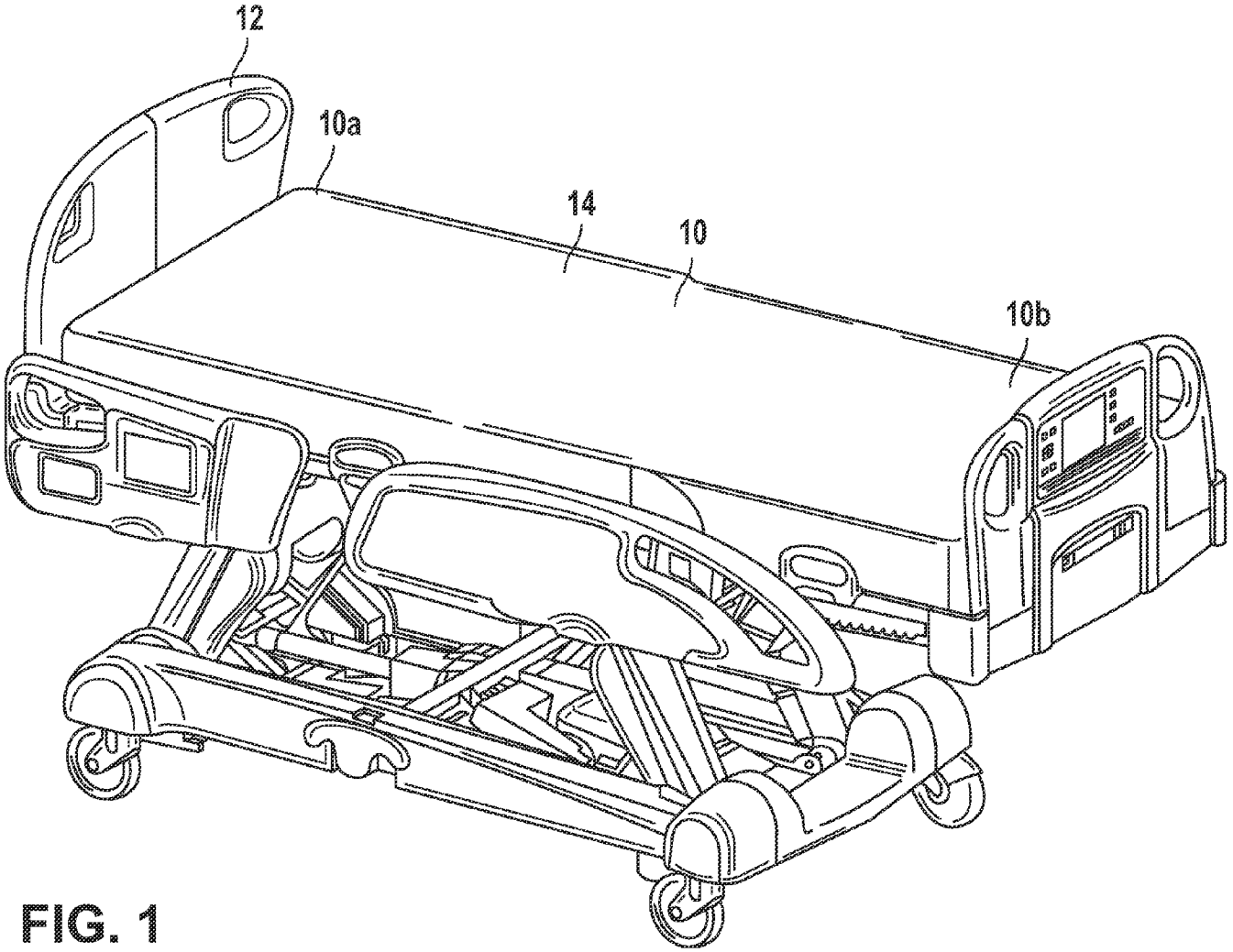
FIG. 1 is a perspective view a patient support shown mounted to a patient support apparatus, for example, a hospital bed.

Referring to FIG. 1, the numeral 10 generally designates a patient support. While described as a "patient" support, it should be understood that "patient" is to be construed broadly to include not only people undergoing medical treatment, but also invalids and other persons, such as long term care persons, who may or may not be undergoing medical treatment. Further, while patient support 10 is illustrated as a mattress, it will be understood that patient support 10 may take on other forms, such as pads, cushions, including cushions for a wheelchair or a stationary chair pads. As will be more fully described below, patient support 10 provides support to a patient's body and, further, may be adapted to provide therapy or treatment to the patient, for example, rotation therapy, percussion therapy, and/or vibration therapy or the like. Additionally, the support surface of the patient support may be configured to provide a low air loss system and/or a control system that automatically determines a suitable immersion level for each individual patient that is positioned on the support, thereby creating an individualized immersion level that is tailored to that specific individual. For further details of a suitable immersion control system reference is made to copending application U.S. Ser. No. 13/836,813, filed Mar. 15, 2013, entitled INFLATABLE MATTRESS AND CONTROL METHODS, which is incorporated by reference herein in its entirety.

Referring again to FIG. 1, patient support 10 is supported on a patient support apparatus 12 that, in this particular embodiment, is a hospital bed. However, patient support apparatus 12 may take on other forms besides a hospital beds, such as, but not limited to, long term care, cots, stretchers, operating tables, gurneys, wheelchairs, and the like. Further, patient support apparatus 12 may be a conventional support apparatus that is commercially available and that merely provides a supporting function for patient support 10.

For example, patient support apparatus 12 may include one or more controls that are integrated therein and which are used in controlling one or more functions of patient support 10, as will be discussed in greater detail below. For example, electrical connectors may be provided for establishing an electrical link between a user interface that is positioned on, or integrated into, the barrier of patient support apparatus 12. The user interface may take on a variety of different forms, such as, but not limited to, a touch screen, a Liquid Crystal Display (LCD), a plurality of buttons, switches, knobs, or the like, or any combination of these components, which allows a user to control the operation of patient support 10. The connection between the interface and patient support 10 may take on different forms, including a direct electrical cable that runs from the footboard to patient support 10, for example by way of electrical connectors that electrically couple the user interface to circuitry supported on or in the frame of the bed, and/or by wireless communication, such as disclosed in commonly assigned, U.S. patent application Ser. No. 13/802,855, filed Mar. 14, 2013, by applicants Michael Hayes et al. and entitled COMMUNICATION SYSTEMS FOR PATIENT SUPPORT APPARATUSES, the complete disclosure of which is hereby incorporated herein by reference. For more exemplary details of a suitable hospital bed reference is made to the beds described in U.S. Pat. Nos. 8,006,332; 7,690,059; 7,805,784; 7,962,981; and 7,861,334, all commonly owned by Stryker Corporation of Kalamazoo, Mich., which are herein incorporated by reference in their entireties.

Figure 2:
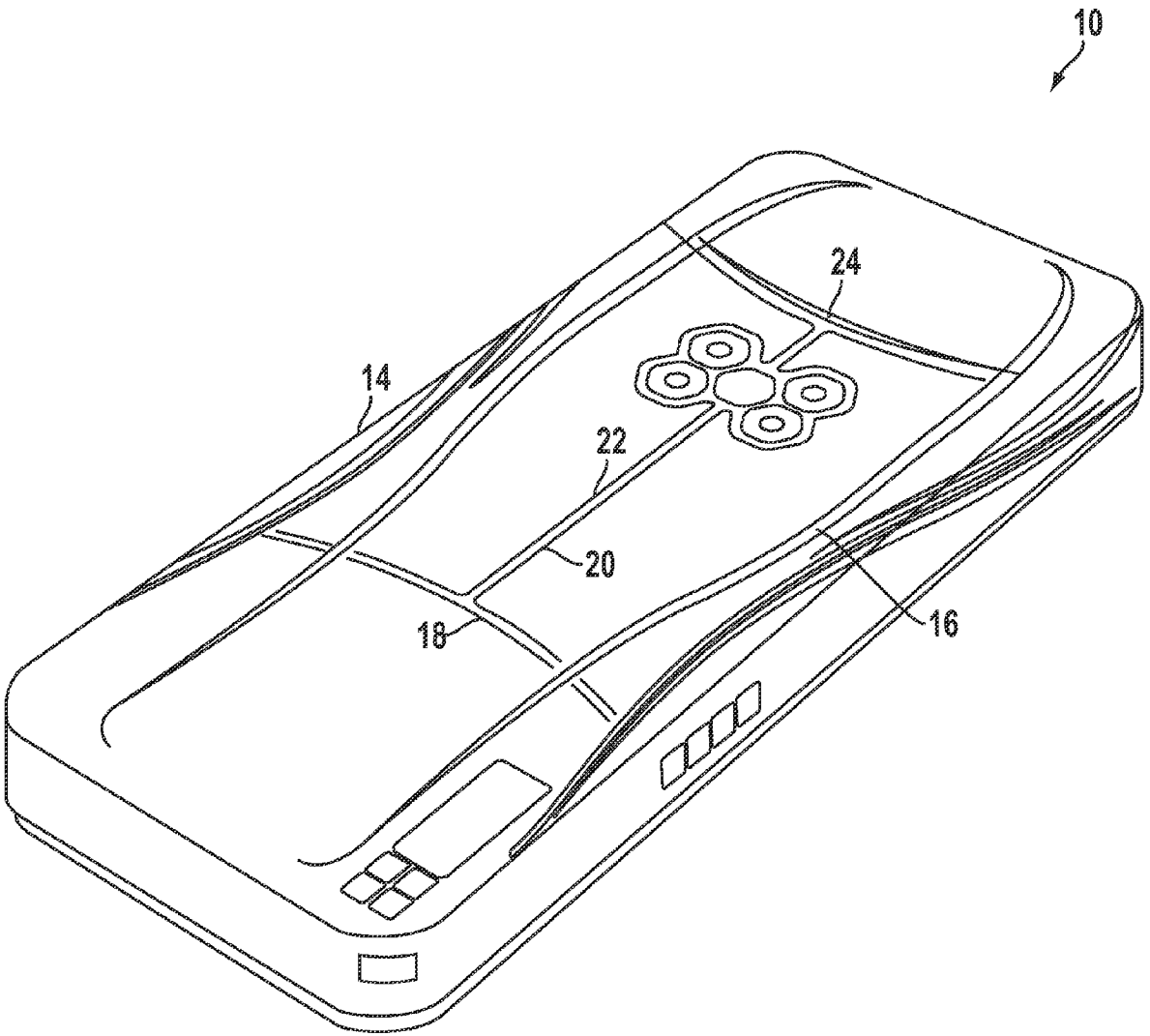
FIG. 2 is a perspective view of the patient support of FIG. 1.

Referring to FIG. 2, patient support 10 includes a cover 14, which provides a plurality of optional features. For example, cover 14 may be formed from a flexible knit material, such as a flexible knit nylon or a nylon-like fabric, which provides a high breathability rate to facilitate moisture management. Additionally, cover 14 may be formed with the knit fibers on the patient facing side of the cover and with an inner surface formed by a stretchy elastomeric membrane that is stretchable so as not to reduce, if not eliminate, any interference with the patient immersion into support 10, as will be more fully described below. Furthermore, as will be more full described below, because cover 14 optionally encloses one or more blowers or fans for circulating air through the support, as part of a low air loss system, cover 14 may incorporate an open mesh panel to allow air to be drawn into the cover 14.

In another aspect, cover 14 may include one or more indicia on its surface. For example, cover 14 may include indicia to define the preferred location for a patient on patient support 10. The indicia may include a demarcation 16, such as a line, that defines the overall general area in which the patient should be positioned in the supine position and additional demarcations 18, 20, 22, and 24, also for example lines, that define the foot area, the thigh and seat areas, the back areas, and the head area of the patient support. In this manner, when a patient is located in the general area and also generally aligned with the sub-areas, the patient will be properly aligned with the support cushioning layers and turning bladders that are configured to provide the appropriate cushioning and functionality to that region of the patient's body.

In addition to the demarcation lines that identify the different areas/sections of the support, other indicia may be applied for example, graphical instructions, representations of the underlying cushioning layers (e.g. the gel or bladders), as well as the location of optional percussion/vibration and/or turning bladders to again facilitate the proper positioning of the patient.

The various demarcations, which for example indicate the different areas of support, i.e. thigh and back support areas, foot support areas, and head support areas, may be applied to the underlying sheet that forms the cover using a heat transfer process. For example, ink that is applied to a carrier sheet may be transferred onto the fabric that forms the cover using heat. In this manner, the ink does not simply coat the fabric, as is the case with silk screening, and instead merges with the fabric (and optionally underlying elastomeric membrane) which provides the sheet with generally constant properties. This tends to reduce the wear and provide increased longevity to the demarcations.

To provide appropriate cushioning and immersion for the patient, patient support 10 includes several cushioning layers, including a bladder layer 26 with a plurality of bladders 26*a*, 26*b*, which provide support to the patient's thighs, seat, back, and head, and a gel layer 28, which provides support to the patient's heels. Bladder layer 26 may be formed from a sheet of gelatinous elastomeric material, which is configured, such as by molding, including injection molding, blow molding, thermoforming, or cast molding, to include a plurality of sacs or cavities, which form upper wall 26*c* and side walls 26*d* of each bladder 26*a*, 26*b*, which is then joined with a bottom sheet 26*e* to form the closed chambers of the bladders (see FIG. 4A). The two sheets are joined together around their respective perimeters and around each of the sacs to form an array of discrete bladders. At least some regions of the sheets may be left un-joined (for example see in FIG. 4A) to form fluid passageways between some or all of the adjacent bladders so that a network of passageways can be formed in the bladder layer to allow air flow between at least some of the bladders, which reduces the amount of tubing that is require to inflate the bladders and to maintain the pressure in the bladders at the desired pressure value. As noted below, some bladders may be grouped together in that they are in communication with each other through the above-noted air passageways, or through tubing, so that the bladders form zones.

Referring to FIG. 2, bladder layer 26 and gel layer 28 are supported so that their top or patient facing surfaces are adjacent each other and positioned generally in the same plane and at the same height (when not loaded with a patient) to form a generally continuous layer of cushioning. Though as noted below, at the interface between the gel layer and the bladders layer, the gel layer may be slightly angled downwardly to provide a more comfortable transition between the adjacent cushion layers.

In the illustrated embodiment, bladders 26*a*, 26*b* are arranged in zones, which optionally may be independently controlled with the inflation/deflation of each zone independent of the other zone or zones. For example, the zones may include a head zone at the head end 10*a* of support 10, a back zone at the back section 10*c* of support 10, seat and thigh zones at the seat and thigh sections 10*d*, and a heel zone at the foot end 10*b* of patient support 10. Further, each zone may be divided, for example into a left sub-zone and a right sub-zone so that when a patient is being turned, the pressure on the bladders on one side may be adjusted (e.g. increased or decreased) to accommodate the motion of the patient. For example, in the illustrated embodiment, the seat zone includes a right seat zone and a left seat zone to facilitate turning the patient. In the illustrated embodiment, the back zone and the head zone are grouped together and, further, positioned so that they will generally be aligned together when the patient is positioned on support 10

Figure 3:
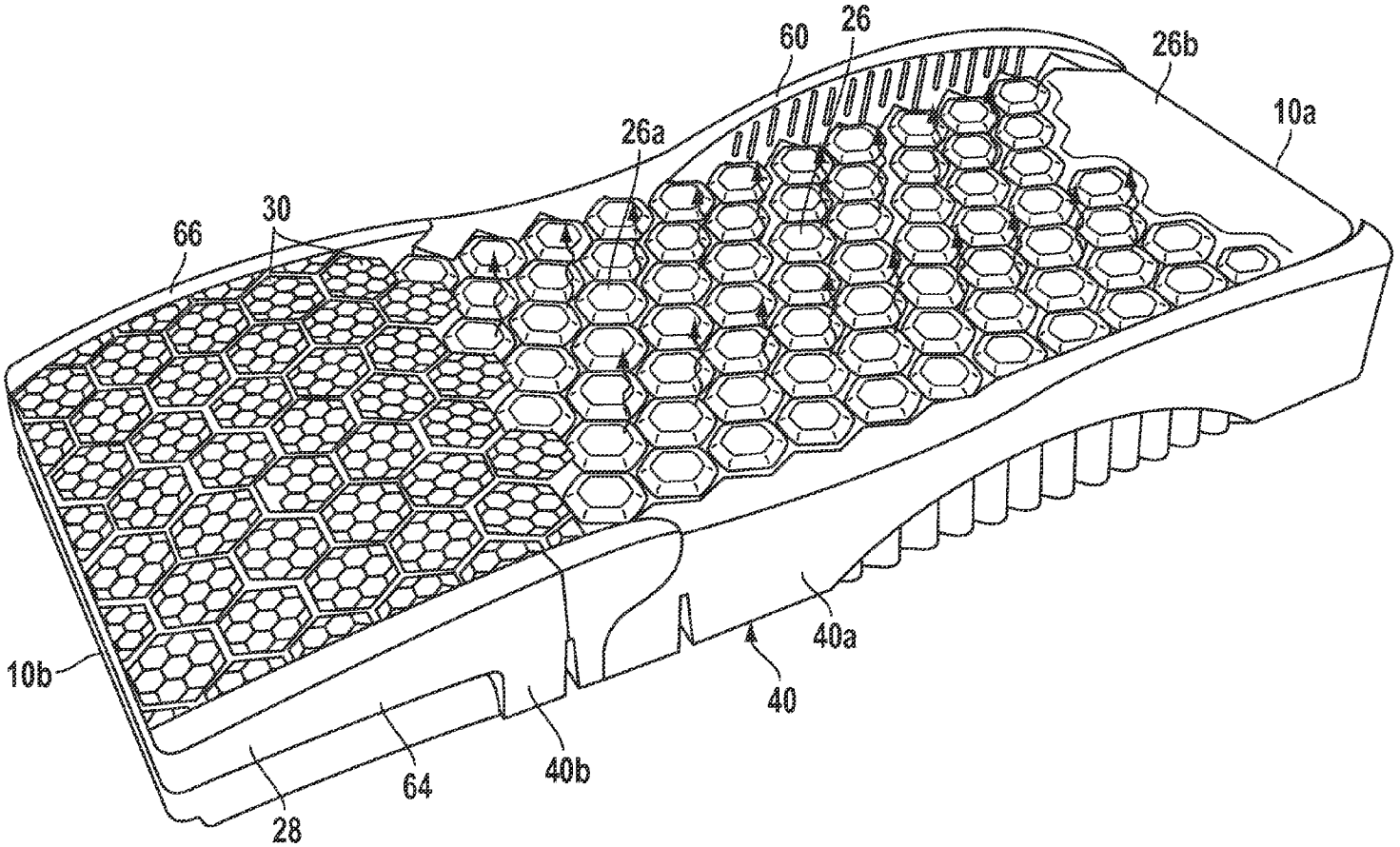
FIG. 3 is a similar view to FIG. 2 with the cover removed to show the internal cushioning layers.
Figure 3A:
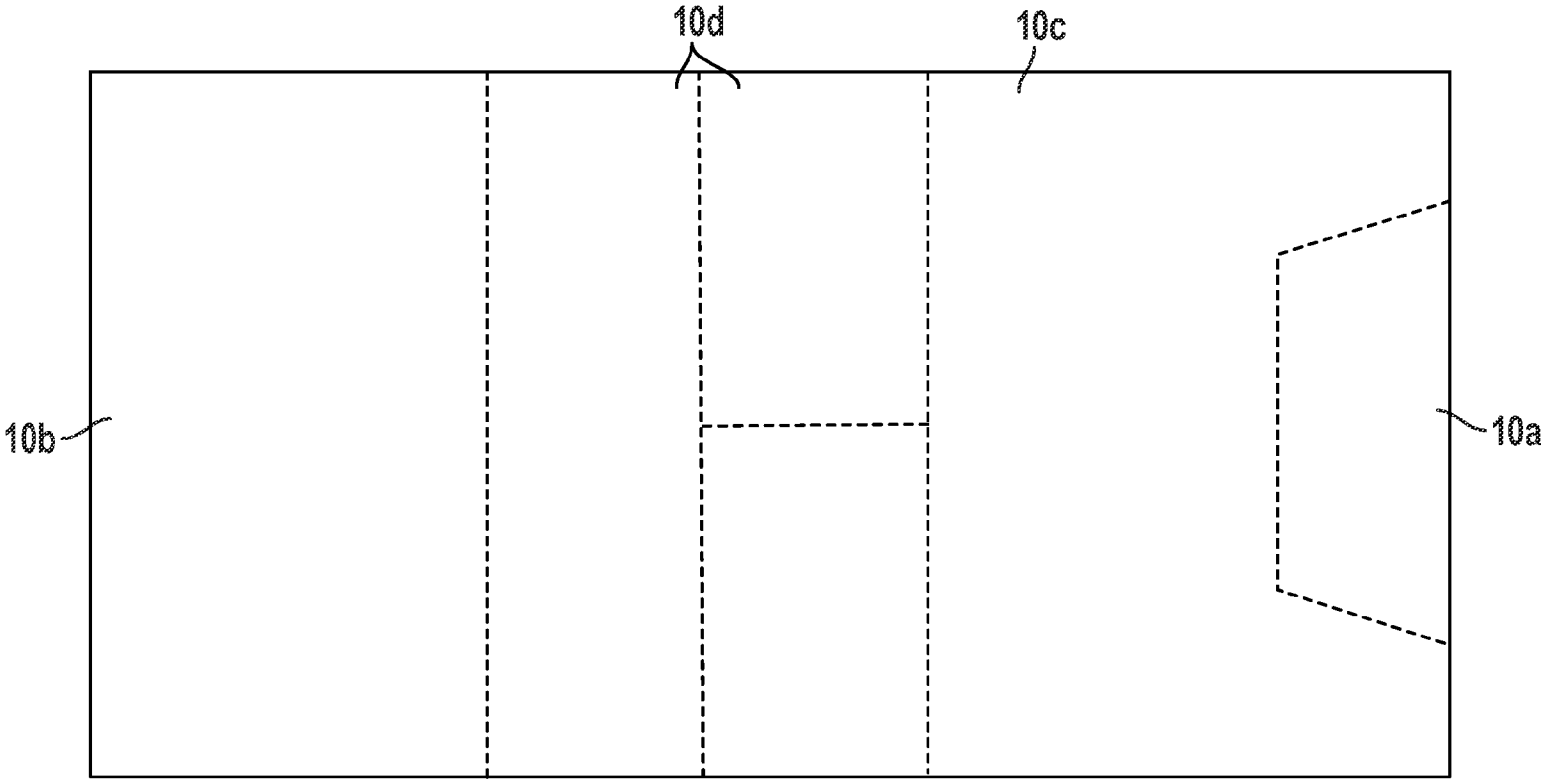
FIG. 3A is a plan view of the patient support illustrating the different areas or zones of the patient support.
Figure 4:
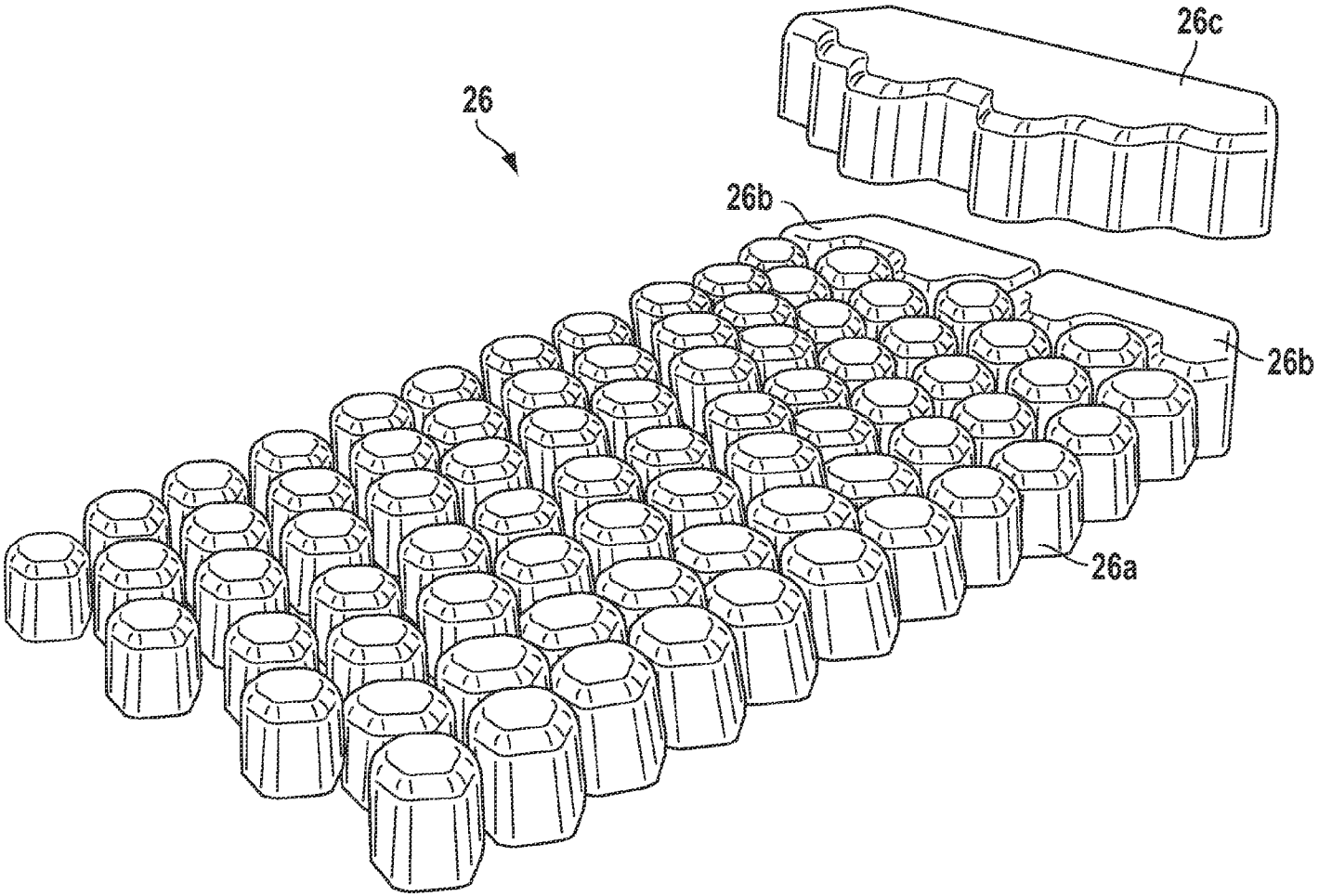
FIG. 4 is a perspective view of the bladder layer of the patient support.

Referring to FIGS. 3 and 4, bladders 26*a* are arranged in rows and columns (rows are transverse to the long axis of the patient support, with columns extending generally parallel to the long axis of the patient support), with each bladder 26*a* in each row offset longitudinally from the adjacent bladder 26*a* to form an alternating pattern in each row so that the bladders are nested with the bladders of the adjacent rows. Further, the lateral center line of each bladder 26*a* extends between its respective adjacent bladders. In the illustrated embodiment, bladders 26*a* each have a hexagonal cross-section so that each bladder edge is offset from the corresponding edge of the adjacent bladder. For further details of the bladder arrangement, materials, and construction, reference is made to copending U.S. patent application Ser. No. 13/022,326, filed Feb. 7, 2011, entitled PATIENT/INVALID HANDLING SUPPORT; Ser. No. 13/022,372, filed Feb. 7, 2011, entitled PATIENT/INVALID HANDLING SUPPORT; Ser. No. 13/022,382, filed Feb. 7, 2011, entitled PATIENT/INVALID HANDLING SUPPORT; Ser. No. 13/022,454, filed Feb. 7, 2011, entitled PATIENT/INVALID HANDLING SUPPORT; Ser. No. 13/548,591, filed Jul. 13, 2012, entitled PATIENT/INVALID HANDLING SUPPORT, all of which are incorporated by reference herein in their entireties.

Referring again to FIGS. 3 and 4, head section bladders 26*b* have a generally block-shaped configuration with the side of bladders 26*b* facing bladders 26*a* having recesses that correspond to the shape of bladders 26*a* to provide a smooth transition between the head end and back section bladders. Bladders 26*b* may also incorporate a cover 26*c* to tie both left side head end bladder and right side head end bladder together to provide uniform support to the patient's head except when the patient is being turned, as described below.

Gel layer 28 is formed from a gelastic material. Suitable gelastic materials include a SEB, SEBS, SEP, SEPS, SEEP, SEEPS polymer combined with a mineral oil, such as disclosed in U.S. Pat. Nos. 3,485,787; 3,676,387; 3,827,999; 4,259,540; 4,351,913; 4,369,284; 4,618,213; 5,262,468; 5,508,334; 5,239,723; 5,475,890; 5,334,646; 5,336,708; 4,432,607; 4,492,428; 4,497,538; 4,509,821; 4,709,982; 4,716,183; 4,798,853; 4,942,270; 5,149, 736; 5,331,036; 5,881,409; 5,994,450; 5,749,111; 6,026,527; 6,197,099; 6,865,759; 7,060,213; 6,413,458; 7,730,566; and 7,964,664, which are all incorporated herein by reference in their entireties.

As one example, the gelatinous elastomeric material may be formulated with a weight ratio of oil to polymer of approximately 3.1 to 1. The polymer may be Kraton 1830 available from Kraton Polymers, which has a place of business in Houston, Tex., or it may be another suitable polymer. The oil may be mineral oil, or another suitable oil. One or more stabilizers may also be added. Additional ingredients—such as, but not limited to—dye may also be added. In another example, the gelatinous elastomeric material may be formulated with a weight ratio of oil to copolymers of approximately 2.6 to 1. The copolymers may be Septon 4055 and 4044 which are available from Kuraray America, Inc., which has a place of business in Houston, Tex., or it may be other copolymers. If Septon 4055 and 4044 are used, the weight ratio may be approximately 2.3 to 1 of Septon 4055 to Septon 4044. The oil may be mineral oil and one or more stabilizers may also be used. Additional ingredients—such as, but not limited to—dye may also be added. In addition to these two examples, as well as those disclosed in the aforementioned patents, still other formulations may be used.

Figure 4A:
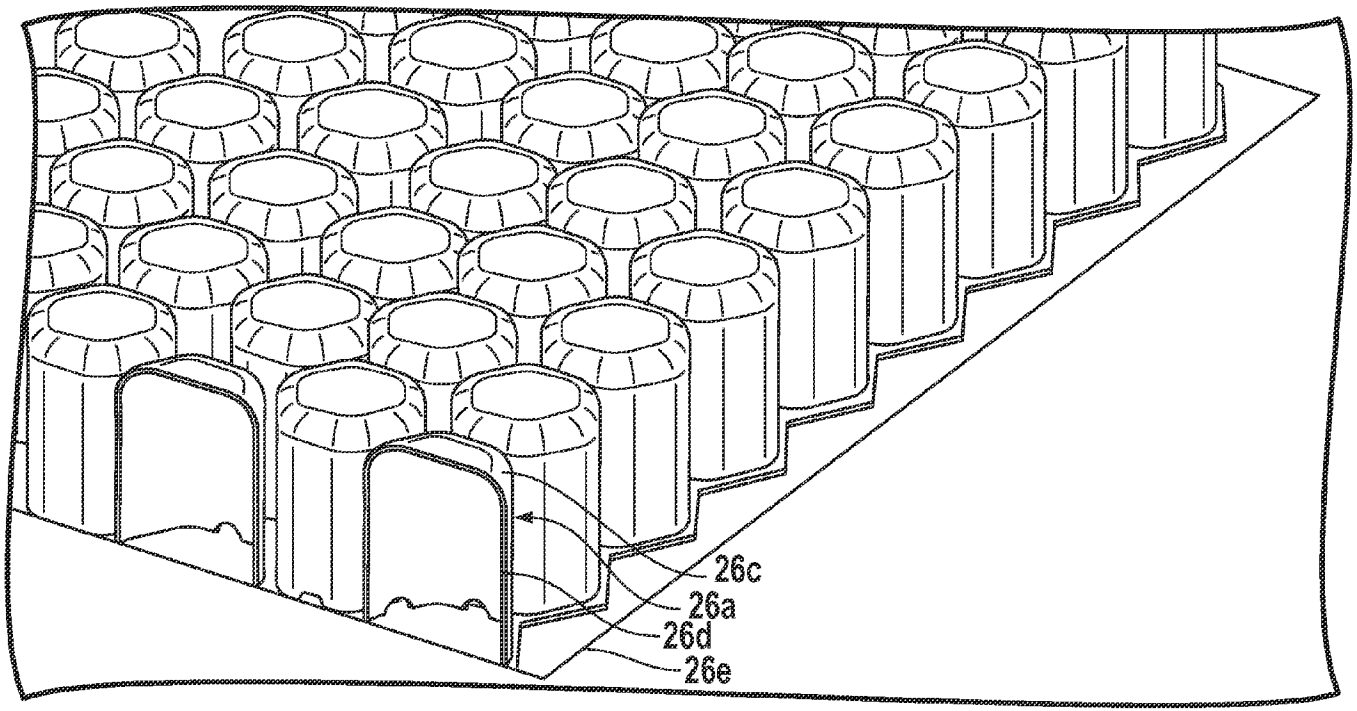
FIG. 4A is a perspective view of the bladder layer with a partial cut-away illustrating the construction of at least some of the bladders.

In the illustrated embodiment, gel layer 28 includes a plurality of gelastic footings that are disconnected from each other so that each footing can compress independently from its adjacent surrounding footing. The term footing is used in the sense that the overall gel structure (defined by gel wall 30) is wider than it is tall. Referring to FIG. 4A, each footing is formed by an outer perimeter wall 30, having a generally hexagonal shape, which is then supported internally by six internal hexagonal-shaped walls, which are arranged in a circular pattern to form a central hexagonal-shaped wall, which is formed by the respective inner walls of the six internal hexagonal-shaped walls, which in turn share walls with the outer perimeter wall 30. In other words, the central hexagonal-shaped wall is not a separate wall and instead is defined by the inwardly facing walls of each internal hexagonal-shaped wall. Similarly, the outer wall of each internal hexagonal-shaped wall is provided or formed by a portion of the outer perimeter wall 30.

For example, the height of each wall may be in a range of about 1" to 4", or in a range of about 2" to 3", and the thickness of each wall may be in a range of about 1/32" to 3/8" or in a range of about 1/16" to 1/4". The width of each footing may be in a range of about 3" to 6" or in a range of about 4" to 5", with each internal hexagonal-shaped wall in a range of about 1" to 2" or in a range of about 3/4 to 1½". To facilitate injection molding, the walls are slightly tapered, for example, to create a draft angle. For example, the draft angle may fall in a range of about 1 degrees to 10 degrees or in a range of about 3 degrees to 8 degrees.

In this manner, each gel footing 30 provides a nested set of interconnected gel walls that tend to buckle under the weight of a patient and continue to provide cushioning support to the patient's heels over the full range of collapse of each group of the internal walls. By spreading the load across multiple walls that are interconnected, but arranged in isolated groups, each grouping will allow greater immersion and provide better redistribution of stress or pressure across the patient's heel then when all the walls are tied together.

In addition, each gel wall of each gel footing may be joined at their lowermost edges by a base sheet of gel, which is relatively thin, like a skin, which is used in the molding process to help distribute the gel material across the full width of the gel layer.

Further, the gel forming gel layer 28 may be selected to very soft, but with the interconnection of the adjacent inner walls still provide adequate support and cushioning to the patient's heel. For examples of other gel configurations that may be used, including gel columns (where the gel structures have a greater height than their width), reference is again made to U.S. Pat. Nos. 3,485,787; 3,676,387; 3,827,999; 4,259,540; 4,351,913; 4,369,284; 4,618,213; 5,262,468; 5,508,334; 5,239,723; 5,475,890; 5,334,646; 5,336,708; 4,432,607; 4,492,428; 4,497,538; 4,509,821; 4,709,982; 4,716,183; 4,798,853; 4,942,270; 5,149, 736; 5,331,036; 5,881,409; 5,994,450; 5,749,111; 6,026,527; 6,197,099; 6,843,873; 6,865,759; 7,060,213; 6,413, 458; 7,730,566; 7,823,233; 7,827,636; 7,823,234; and 7,964,664, which are all incorporated herein by reference in their entireties.

As best seen in FIG. 3, bladder layer 26 and gel layer 28 are supported by a foam crib 40. Crib 40 optionally includes a first portion 40*a* that extends under bladder layer 26 from the head end to the thigh region of the patient and a second portion 40*b* that extends under the gel layer from below the thigh region to foot end 10*b* of patient support 10. Crib 40 tends to keep the softer cushion layers of the bladders and gel in place while also providing a firmer rail along both sides of support 10.

Figure 5:
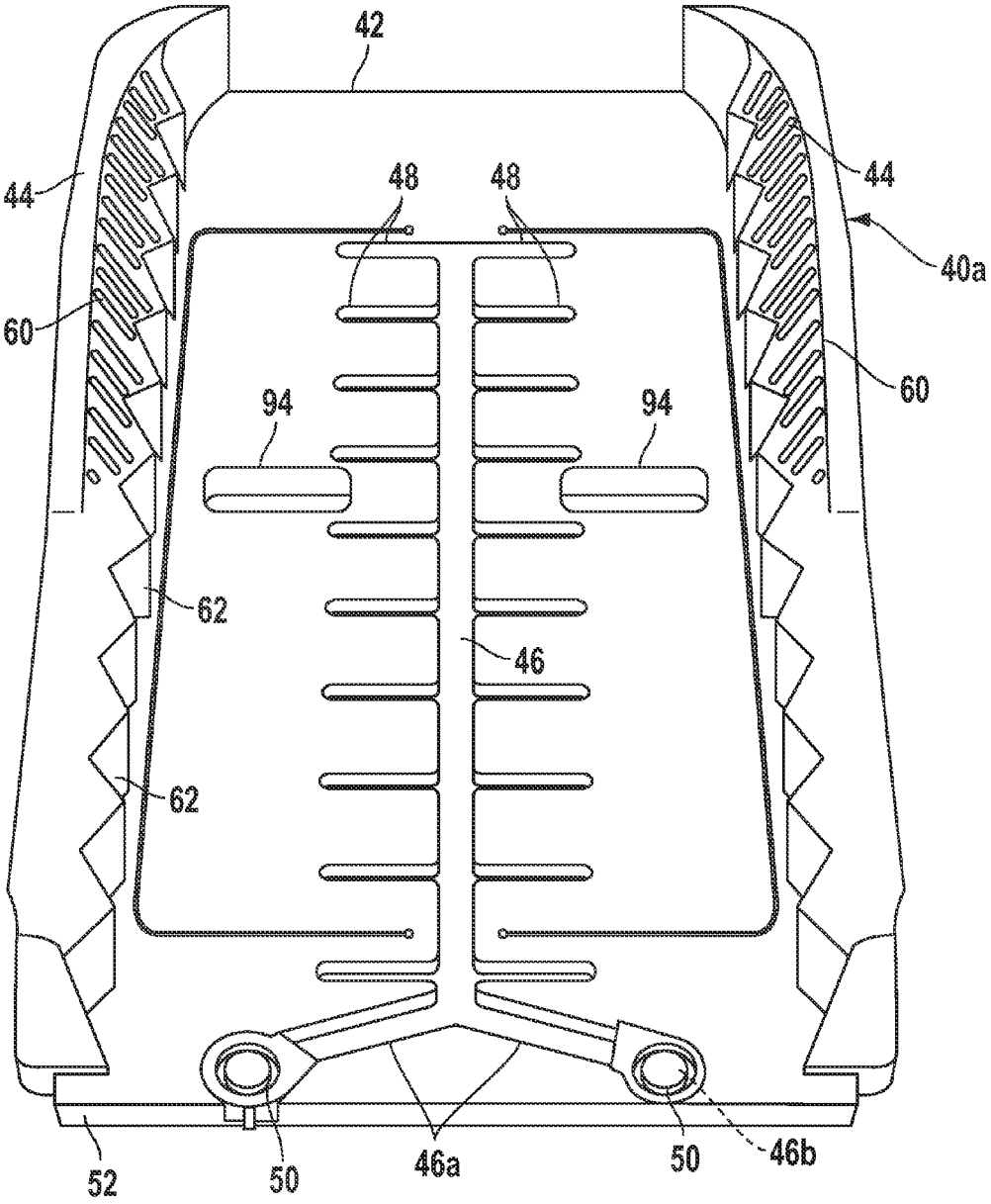
FIG. 5 is a perspective view of the foam crib that supports the bladder layer.
Figure 6:
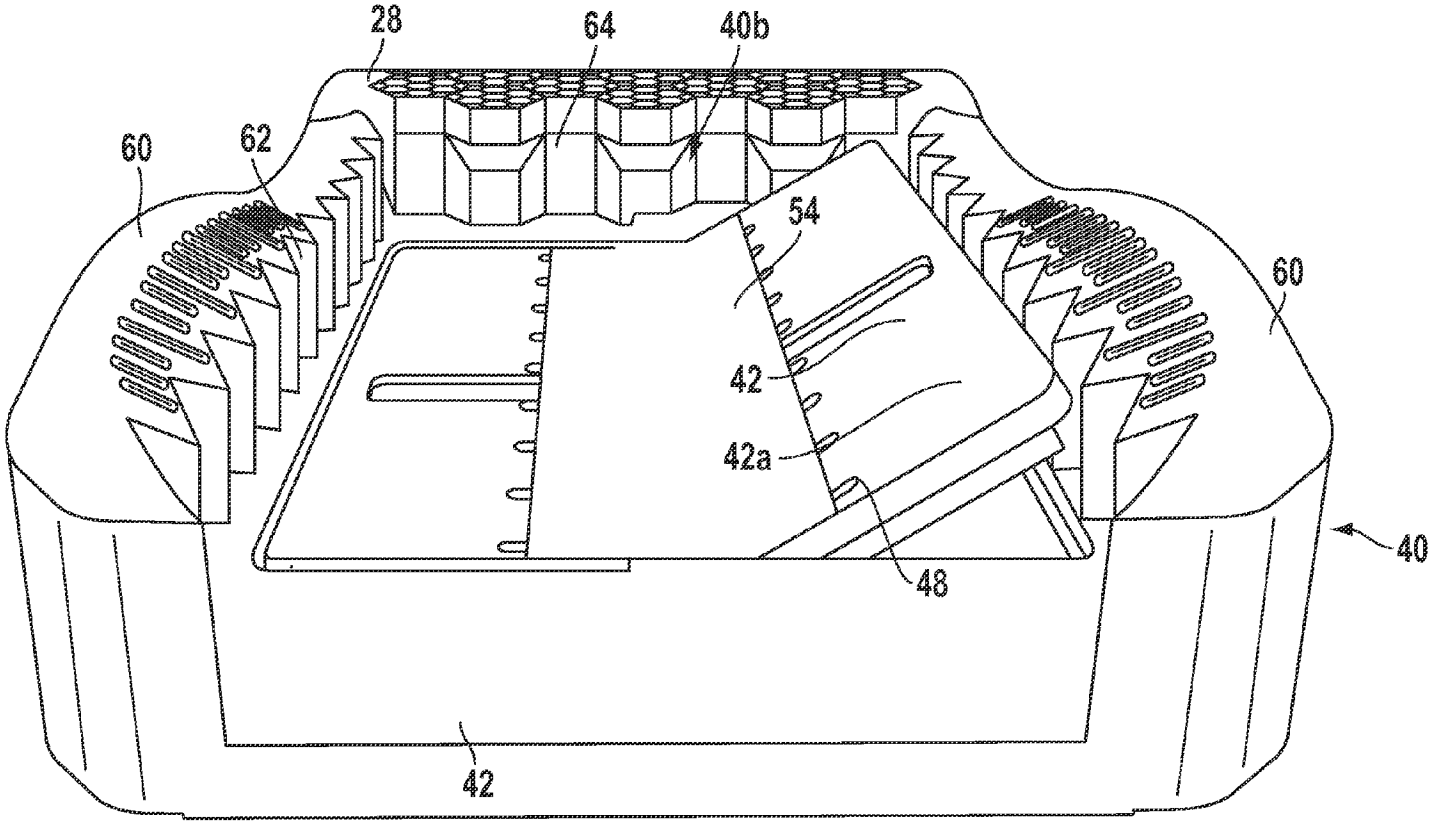
FIG. 6 is a bottom perspective view the foam crib of FIG. 5 illustrating the foam crib with a hinged panel.

Foam crib portion 40*a* includes a base wall 42 and a pair of upwardly extending sidewalls 44, which as noted form a foam rail along opposed sides of bladder layer 26 to facilitate entry to and exit from the bed, and to cradle the patient when they are in the supine position. Referring to FIGS. 5 and 6, base wall 42 of crib 40 includes a plurality of channels that form a branching or tree-like configuration with a central channel 46 and a plurality of laterally extending branch channels 48, which are in fluid communication with central channel 46. Central channel 46 is in fluid communication with inlet or feeder channels 46*a* formed at the base of central channel 46. And, each inlet channel 46*a* includes a recess 46*b* for receiving a blower unit 50, whose output is directed toward the central channel 46 through inlet or feeder channel 46*a* and whose intake extends through the lower edge of base wall 42 so that when blower units 50 are covered by bladder layer 26, the blower units can draw in air from the space adjacent the lower end of foam crib 40, as will be more fully described below. These channels also facilitate the bending of foam crib, described below.

Blower units 50, when operated, blow air into channels 46*a* and 46, which in turn distribute the air into branch channels 48 to generate air flow into the bladder layer 26 from beneath. To allow the air to flow through bladder layer 26, the base sheet of bladder layer 26 includes a plurality of openings so that air can flow up through the bladder layer 26 and between the bladders 26*a* as indicated by the arrows in FIG. 3. To better focus the flow of air, base layer 42 may incorporate a sheet of non-woven material 54 (FIGS. 2A and 6) adhered to its surface, which extends over inlet channels 46*a*, central channel 46, and portion of branch channels 48 to leave the distal end of each branch channel open so that they direct air into the bladder layer 46 at discrete space locations.

Referring again to FIG. 5, each sidewall 44 of crib 40 has an upper wedge-shaped portion 60 adjacent at least the shoulder area of a patient supported on patient support 10. Wedge-shaped portions 60 form angled surfaces facing the patient, at the patient's shoulder region, which extend above the upper surface of bladder layer 26 when inflated and unloaded, and extend above bladder layer 26 at an even greater height when a patient is placed on bladder layer 26. Therefore, wedge-shaped portions 60 provide lateral support to a patient at their shoulders, but are sufficiently resilient to collapse down to the underlying base of sidewall 44 when a patient exits the bed.

Inwardly facing sides of sidewalls 44 optionally include a plurality of recesses 62 that at least generally follow the contour of each adjacent bladder 26*a* to thereby provide lateral support to each adjacent bladder both in the lateral and longitudinal direction. As a result, bladders 26*a* are held in place and, to a certain extent, somewhat interlocked with each other given their own interlocking arrangement. Similarly, as seen in FIG. 3, the inwardly facing edge of gel layer 28 may include a plurality of recesses to receive the bladders adjacent the gel layer so that the foot end bladders are similarly laterally and longitudinally supported by the adjacent gel layer.

As best seen in FIG. 6, foam crib portion 40*b* similarly has a base wall 64 with a pair of upwardly extending sidewalls 66 that similarly include recesses that generally match the shape of the respective gel footings and recesses formed between each gel footing. In a similar manner to the bladders, sidewalls 66 therefore provide lateral and longitudinal support to each of the adjacent gel footings that run along the edge of the gel layer 28. In this manner, each layer is interlocked with its adjacent layer so that all three materials (foam, air-filled bladder, and gel) form a cushioning system.

Further, foam base wall 66 of foam crib section 40*b* includes a plurality of recesses to receive the lower ends of each bladder at the foot end of bladder layer 26 and, further, provide downwardly tapered upper surfaces adjacent each recess so that the gel footings at the thigh end of gel layer 28 are sloped downwardly to provide a smooth transition between the adjacent gel layer and bladder layer. This transition is optionally aligned generally between the knee and thigh of the patient supported on patient support 10.

Figure 2A:
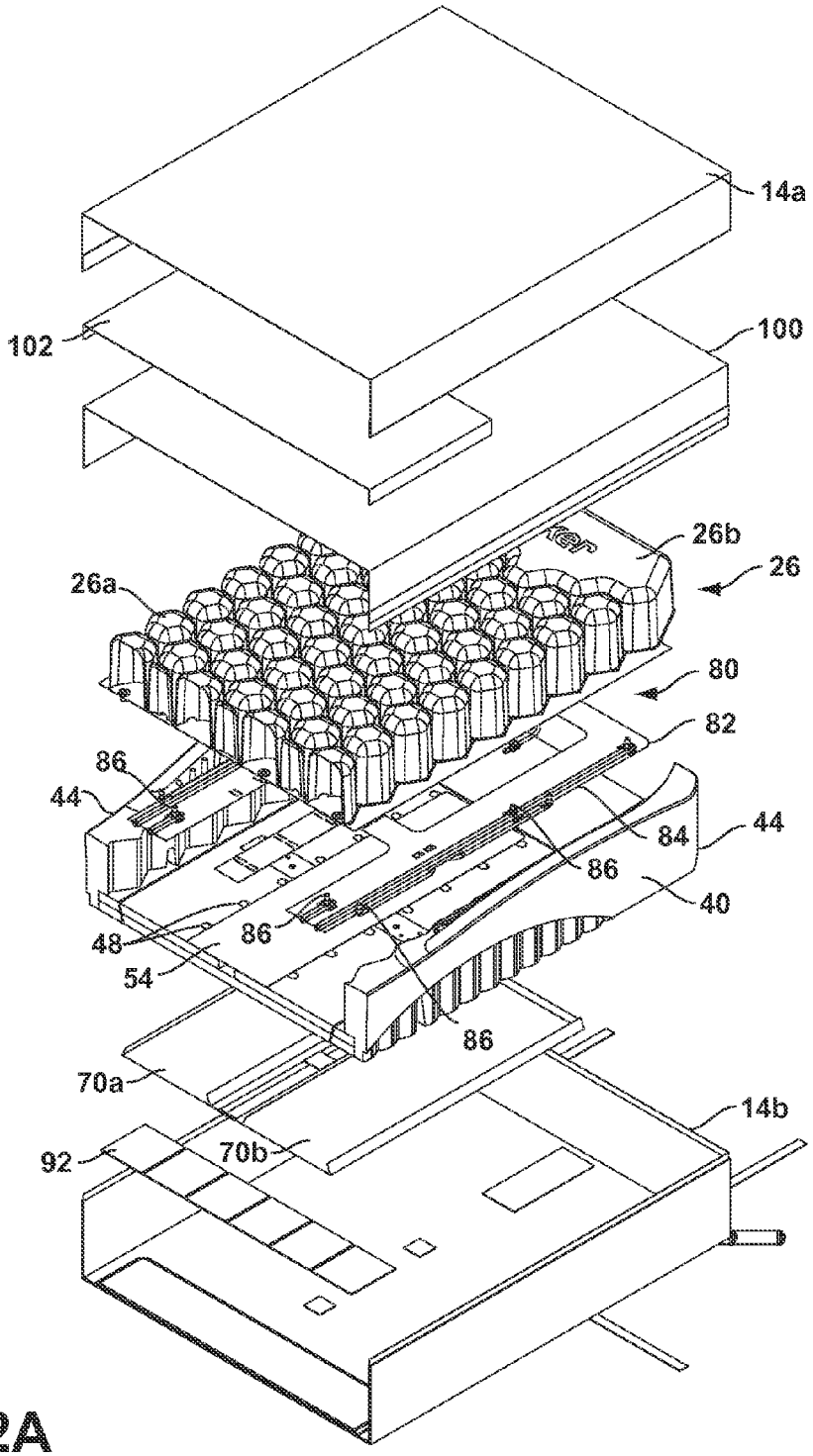
FIG. 2A is an exploded fragmentary view of the patient support illustrating the various cushioning layers and components that may be incorporated into the patient support.

As best seen in FIG. 2A, patient support 10 optionally includes a pair of turning bladders 70*a* and 70*b*. Turning bladders 70*a*, 70*b* are positioned beneath crib 40. Referring to FIG. 5, bladders 70*a* and 70*b* are aligned under sectioned portions 42*a* and 42*b* of base wall 42 of crib 40, which are detached from the remainder of the crib along three sides to form hinged panels, which are hinged at the center of crib 40 so that they can lift up when one of the turning bladders is inflated. To prevent the hinged panel from falling into the crib, each panel optionally includes an L-shaped rim that generally aligns with a corresponding L-shaped sill in the balance of the crib that extends around the detached panels.

To deliver air to bladders 26*a* and 26*b* and to turning bladders 70*a* and 70*b*, support 10 includes a pneumatic system. In this illustrated embodiment, and referring to FIG. 2A, the pneumatic system includes a pneumatic harness 80, which includes a plurality of tubing sections 84 that are supported and secured to a fabric carrier 82 that secures the various tubing sections and associated connectors 86 in their desired configuration and locations. In this manner, when harness 80 is placed over crib 40, the tubing and its associated connectors can be easily aligned with the appropriate inlets for inflating the respective bladders. Together, the tubing and fabric carrier form a flexible manifold that can be easily located in a position with an inlet end (where the tubing exits the carrier) positioned and aligned for coupling to the pump or pumps (of the pneumatic supply system) that supply the air to the respective bladders. The pump or pumps that supply air to the tubing are optionally located in a box at the foot end of the support, more fully described below.

Figure 7:
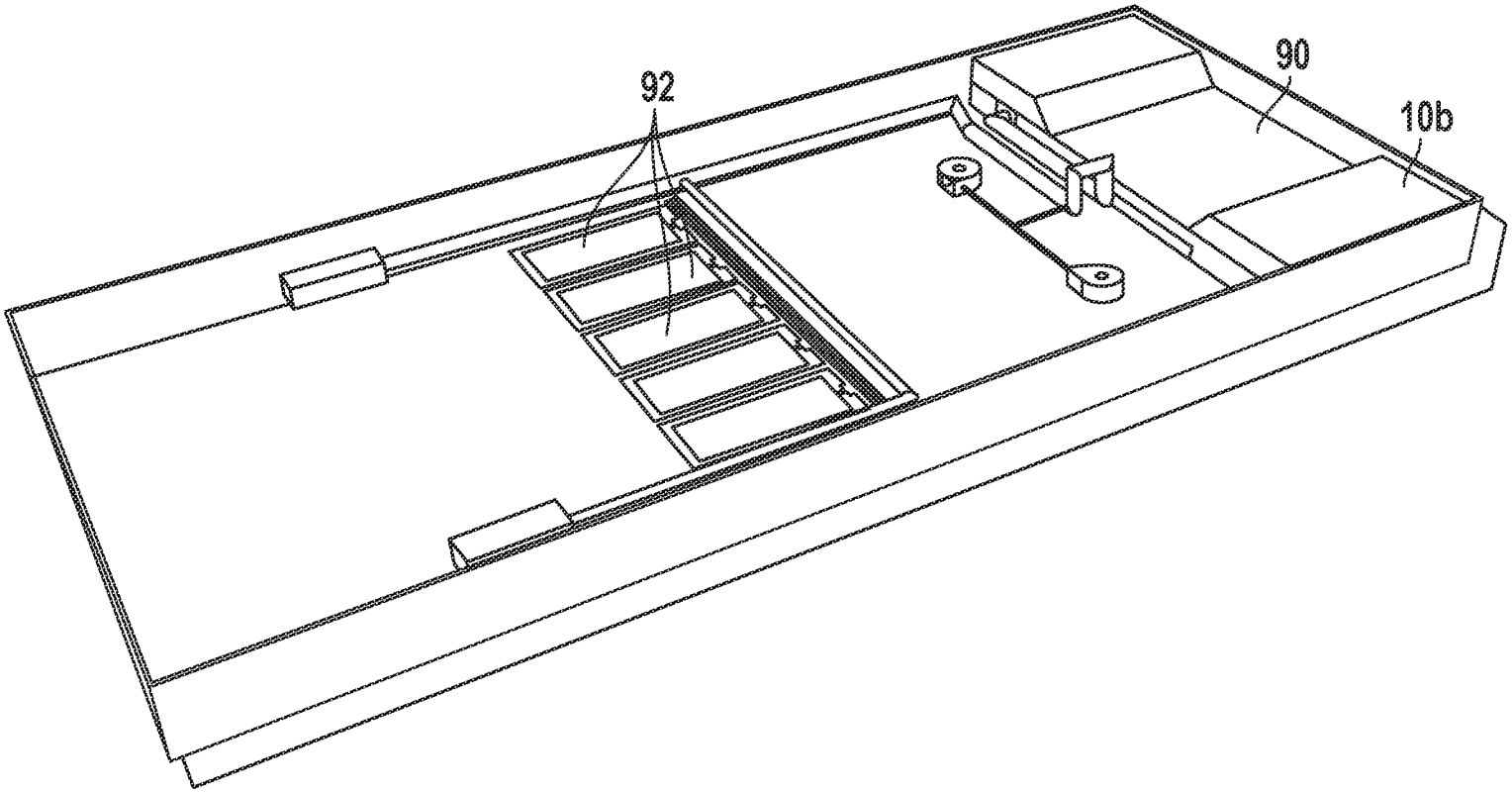
FIG. 7 is a perspective view of the base of the patient support.

As noted above, the various tubing that supplies the bladders with air are coupled to a pump or pumps 90*a*, which in the illustrated embodiment are located in a pump box 90 shown in FIG. 7. Pump box 90 is preferably located at the foot end 10*b* of the patient support 10 and further beneath the crib portion 40*b* under gel layer 28. Pump box 90, for example, may be formed from a polymeric material and has a centrally located recess typically located under the heels of a patient to provide increased immersion depth for the heels of the patient when the patient is lying on patient support 10. In addition to storing or holding the pump or pumps 90*a*, pump box 90 may also include a CPR manifold, which when opened allows the air from the bladders to be dumped so that the patient is then supported directly on the crib beneath the bladders, which provides a firmer surface to allow CPR to be administered to the patient. In addition to a pump or pumps 90*a*, box 90 may also house various controls and circuitry for controlling the pump or pumps and for other devices that may be incorporated into patient support.

As noted above, bladders 26*a*, 26*b* are inflated, or deflated, in groups or zones as described above under the control of box 90 and its associated pumps and control circuitry. The fluid connections between the bladders and box 90 (and the pump or pumps 90*a* contained therein) are established by the tubing 84 that run between box 90 (the pump or pumps 90*a* housed in box 90) and the various bladders and which connect to inlets on the bladders by connectors 86. As noted above, tubing 84 is attached to fabric carrier 82, which together forms the flexible manifold 80.

Similarly, manifold 80 may support the tubing for turning bladders 70*a*, 70*b*, which extend generally longitudinally in a direction from the head end 10*a* to foot end 10*b*, and as noted are positioned underneath foam crib 40 and are used to help turn a patient positioned on top of patient support 10. To that end, turning bladders 70*a* n 70*b* are each separately and independently inflatable and deflatable, which is also controlled by box 90 and its associated circuitry.

For example, as discussed in reference to copending application U.S. Ser. No. 13/836,813, filed Mar. 15, 2013, entitled INFLATABLE MATTRESS AND CONTROL METHODS, patient support 10 may incorporate sensors, such as depth sensor plates 92 (FIG. 7), for sensing the immersion of a patient into the surface. Based on the sensed immersion, the controller, which also may be located in box 90 or elsewhere, including for example in recesses 94 formed in foam crib 40 (FIG. 5), may be used to optimize the immersion of a patient into the surface based on the individual needs of a patient. In order to assist depth sensor plates 92, support 10 incorporates a conductive fabric 102 (FIG. 2A), which together function as capacitive sensors whose output changes as a patient moves closer or farther away from them. More specifically, conductive fabric 102 functions in a manner similar to the top plate of a parallel plate capacitor, while depth sensor plates 92 form the bottom plates of the parallel plate capacitor. Thus, as the vertical distance between conductive fabric 102 and any of the depth sensor plates 92 changes, the capacitance between the fabric 102 and the plate(s) 92 will change. This change is detected by a detector circuit that is electrically coupled between fabric 102 and each of the depth sensor plates 92. That is, one or more wires (not shown) are electrically coupled to fabric 102 and the detector circuits, while one or more other wires (not shown) are connected between each plate 92 and the detector circuit. Conductive fabric 102 may be any commercially available fabric that is electrically conductive, or it may be an electrically conductive foil, or any other material that is electrically conductive, and that is flexible enough to not significantly alter the flexibility of patient support 10 in that region.

As best seen in FIG. 2A, fabric 102 is positioned on top of bladder layer 26 but over a fire sock or barrier 100, which wraps around bladder layer 26 and is made of any suitable material that resists the spread of fire. Such materials may vary. In one embodiment, fire barrier 100 may be made of, or include, Kevlar® (poly-paraphenylene terephthalamide), or other brands of para-aramid synthetic fibers. Other materials may alternatively be used. Cover 14, which includes an upper cover portion 14*a* and a lower cover portion 14*b*, therefore encloses fabric 102, sock 100, bladder layer 26, gel layer 28, crib 40, turning bladders 70*a*, 70*b*, and plates 92, as well as pump box 90 and the pneumatic manifold. For example, upper cover portion 14*a* and a lower cover portion 14*b* may be secured together by a zipper, which allows access to the various components inside support 10.

As noted above, when one of the turning bladders is inflated, the corresponding hinged panel of foam crib will raise up. At the same time, the air in the bladders above the rising panel may either be maintained or increased, while the pressure on the bladders on the opposite side may be reduced or even deflated.

In addition to turning a patient, sections of patient support 10 may be folded to accommodate the Fowler being raised or the leg section of being lowered. For example, support 10 may be supported on a bed with an articulating deck, with a head section, a back section, a seat section and a leg section, with one or more sections being pivotable to raise the Fowler or leg sections as noted. To accommodate the articulating deck, foam crib 40 may include a corresponding gatch for each point of articulation (see FIG. 3). Further, cover 14 may include a V-shaped section (no shown) which extends into its underside and into one of the gatches to similarly accommodate the bending of support when one of the deck sections is pivoted. For example, the open mesh that was noted above may be located in the V-shaped section to allow air to be drawn into the cover when blower units are running to circulate air through the cover. Though it should be understood that the mesh panel may also be located elsewhere, including on a bottom side of cover 14.

When assembled, therefore, patient support 10 not only includes a cushioning layer or layers that provide a pressure redistribution system to enhance the support of a patient lying upon support 10 but also optionally provides a moisture management system, as well as an immersion control system. As noted above, additional functionalities may be provided in a form of configuring some of the bladders as percussion and/or vibration bladders, such as described in the referenced copending applications. It should be understood that patient support 10 may be modified to include one or more bladders in the foot zone in lieu of the gel layer and, therefore, the air pressure inside of these bladders could be monitored and controlled by the same system that controls the thigh, seat and head section bladders.

Figure 11:
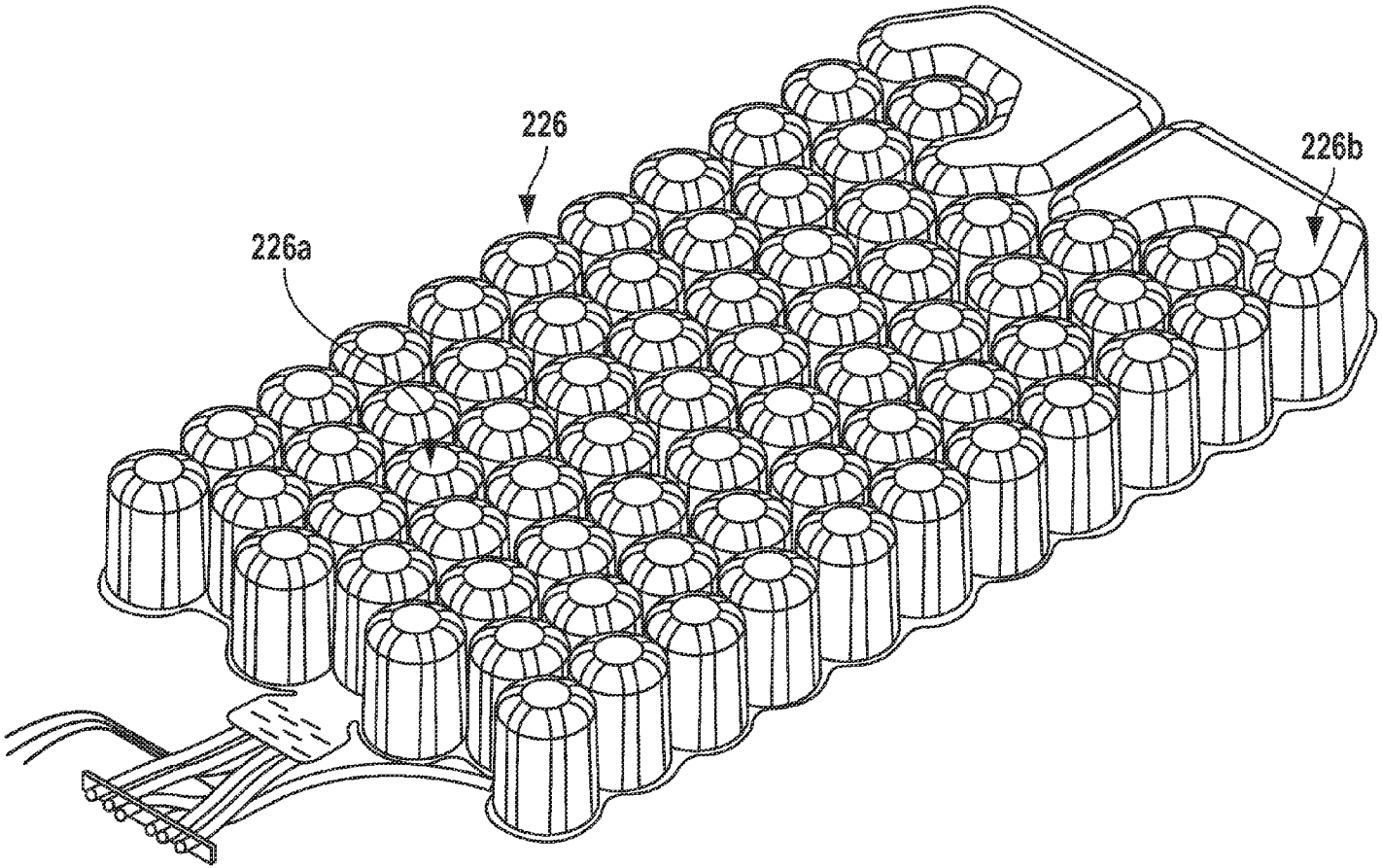
FIG. 11 is a perspective view of another embodiment of a bladder layer of the patient support apparatus.

Referring to FIG. 11, the numeral 226 generally designates another embodiment of a bladder layer. Bladder layer 226 similarly includes a plurality of bladders 226*a*, 226*b* that provide support to the patient's thighs, seat, back, and head. Similar to the bladder layer described above, bladder layer 226 may be used in combination with a gel layer, which provides support to the patient's feet/heels, and a foam crib, which supports both the bladder layer and the gel layer and provides other functions described above and below. For additional details not mentioned below of a suitable gel layer and a foam crib reference is made herein to the above embodiment.

Figure 16:
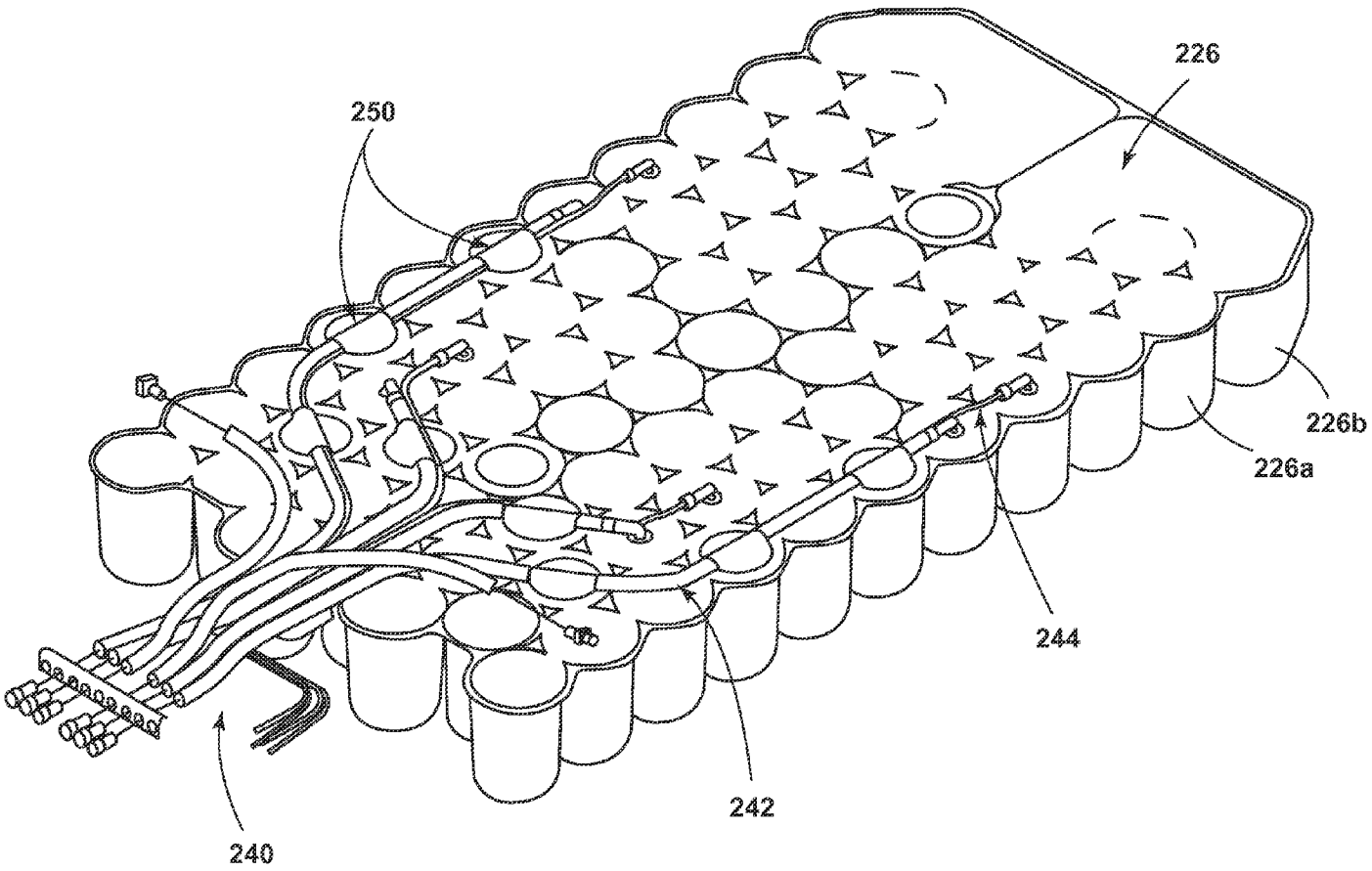
FIG. 16 is a bottom perspective view of the bladder layer of FIG. 11.
Figure 17:
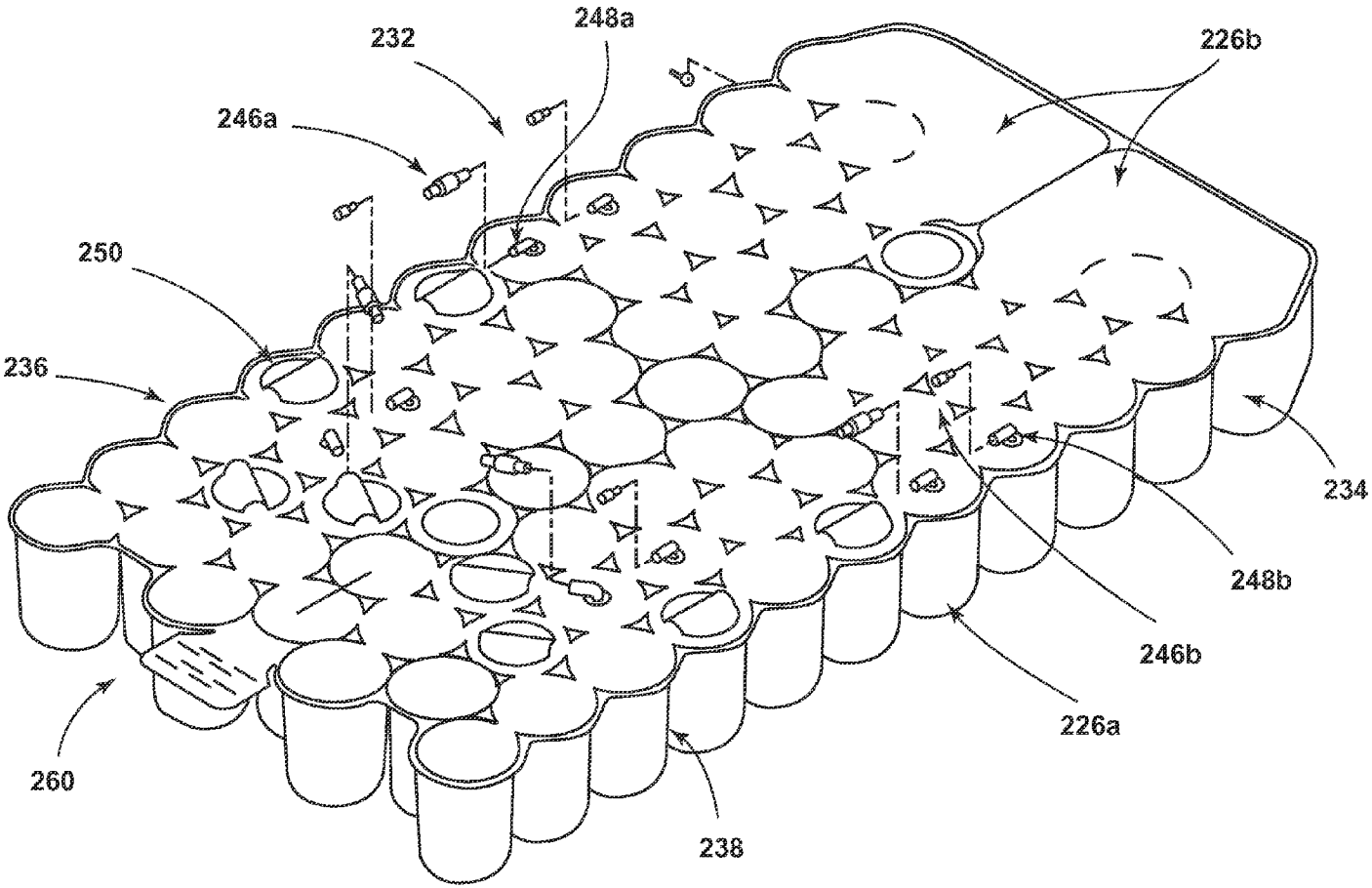
FIG. 17 is a similar view to FIG. 16 with the tubing removed for clarity.
Figure 18:
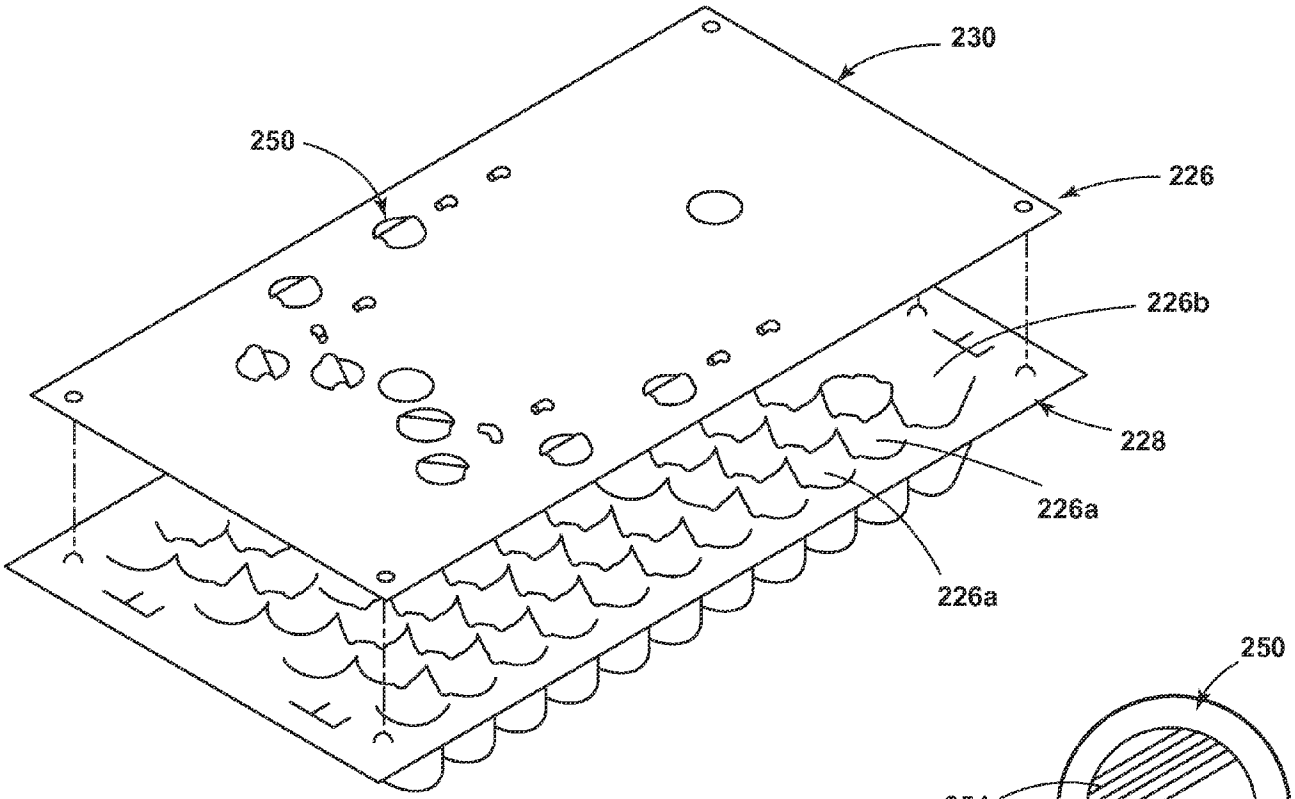
FIG. 18 is an exploded perspective view of the bladder layer of FIG. 17.

Referring to FIG. 18, bladder layer 226 may be formed from an upper sheet 228 and a lower sheet 230. As best seen in FIGS. 16 and 17, upper sheet 228 and lower sheet 230 are joined together, such as by an adhesive or by welding or the like, to form bladders 226*a* and 226*b*, and further in a manner to form a plurality of zones where groups of bladders are in fluid communication with each other but not with the bladders of the other zones. For example, in the illustrated embodiment, bladders 226*a* and 226*b* are grouped into left and right head and back zones 232, 234 and seat zones 236 and 238.

Again referring to FIG. 18, bladders 226*a* and 226*b* are first formed in their extended configurations, for example, by thermoforming, and then joined with lower sheet 230. When formed in their extended configurations, each bladder forms a "pod" which is configured with a hexagonal cross-section so that the pods can be more closely nested than, for example, round or can shaped bladders. Further, the bladders can be arranged so that their edges do not align and instead are offset between adjacent bladders, which as described above, reduces the ability of a patient to detect the edges of each bladder and hence improve their comfort.

Referring to FIG. 16, bladder 226*a* and 226*b* are inflated by a pneumatic system 240, which is controlled by a control system described above. Pneumatic system 240 includes a pneumatic supply system, in the form of a pump 90*a* and a manifold 350 (which are housed in a pump box, such as pump box 90 described above), and a plurality of supply tubes 242. Tubes 242 extend under bladder layer 226 and couple thereto and are in communication with each of the respective zones of the bladder layer via couplers 246*a* (FIG. 17). Couplers 264*a* connect to inlet ports 248*a* provided in bladder layer 226 so that each zone can be separately or independently inflated. Tubes 242 also couple to the turning bladders beneath the foam crib. Additionally, the control system includes a plurality of sensing tubes 244 that extend under bladder layer 226 and couple to and are in communication with each of the respective zones of the bladder layer via couplers 246*b* (FIG. 17). Couplers 246*b* connect to inlet ports 248*b* provided in bladder layer 226 so that the pressure in each zone can be independently measured by sensors mounted remotely from the bladders, for example, in the control compartment or pump box (90) described in the above. As will be more fully described below, bladder layer 226 is adapted to support and guide the supply and sensing tubes to the respective zones. Optionally, therefore, the bladder layer may form a carrier for the tubes, which can facilitate the assembly of the patient support.

Figure 19:
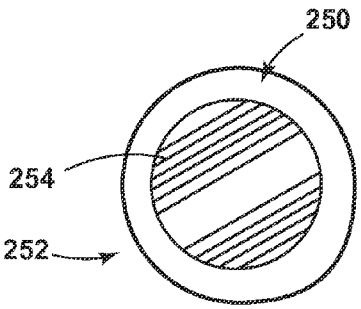
FIG. 19 is an enlarge plan view of the supports mounted at or to the bottom surface of the bladder layer.

As best seen in FIGS. 16 and 17, bladder layer 226 includes a plurality of supports 250 for mounting support tubes 242 and 244 to bladder layer 226. For example, supports 250 may comprise channels that are formed or attached at or to the bottom surface of bladder layer 226. Suitable supports may be formed from patches of sheet material that are adhered or welded at or to the bottom surface of bladder layer 226. As best seen in FIG. 19, supports 250 may be formed from circular patches 252 of material, for example, nylon, which are attached by welds 254 at or to the bottom or underside of bladder layer 226, for example to lower sheet 230. Alternately, an additional sheet may be provided and joined with the lower sheet, with the supports mounted to the additional sheet. It should be understood that supports 250 may be used to support both tubes 242 and tubes 244, or separate supports may be provide for tubes 242 and 244. Thus, bladder layer 226 and the tubes may remain in close registry when being handled, for example, either during the assembly process or cleaning process.

Referring to FIGS. 12, 13, and 15-17, bladder layer 226 may include a harness 260 for supporting and optionally holding tubes 242 and/or 244. For example, harness 260 may be formed by the upper sheet 228 or the lower sheet 230 of the bladder layer or both. Alternatively, harness 260 may be formed from a section of sheet that is attached to one or both of the bladder layer sheets, for example by stitching adhesive, or welding or the like.

In the illustrated embodiment, harness 260 comprises an extension of the respective sheet or sheets of the bladder layer, for example, in the form of a flange 262, which is adapted to support the supply tubes. Optionally, upper sheet 228 of bladder layer has a greater thickness than lower sheet 230 to accommodate the stretching that may occur when forming bladders 226*a* and 226*b*. For example, the upper sheet (228) may have a thickness in a range of about $^{40}/_{1000}$ to $^{120}/_{1000}$ of an inch, or about $^{60}/_{1000}$ to $^{100}/_{10000}$ of an inch, or about $^{80}/_{1000}$ of an inch. The bottom sheet (230) may have a thickness in a range of about $^{10}/_{1000}$ to $^{35}/_{1000}$ of an inch, or about 15/1000 to 30/1000 of an inch, or about 20-25/1000 of an inch. In this manner, the flange may be formed from the thicker of the two sheets or the two sheets combined to provide increased strength.

Figure 13:
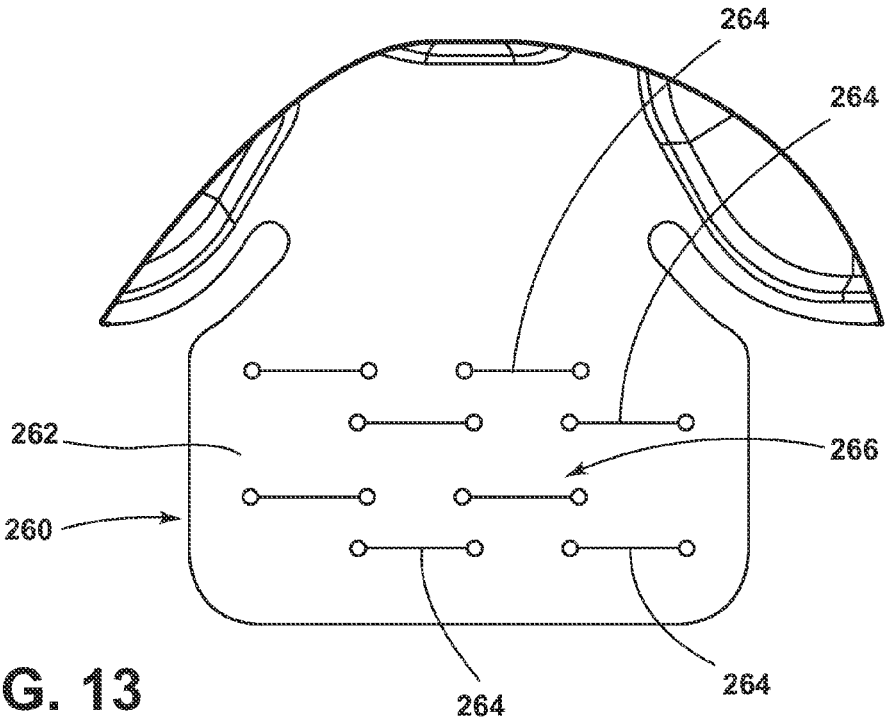
FIG. 13 is an enlarged view of detail XIII of FIG. 12.
Figure 15:
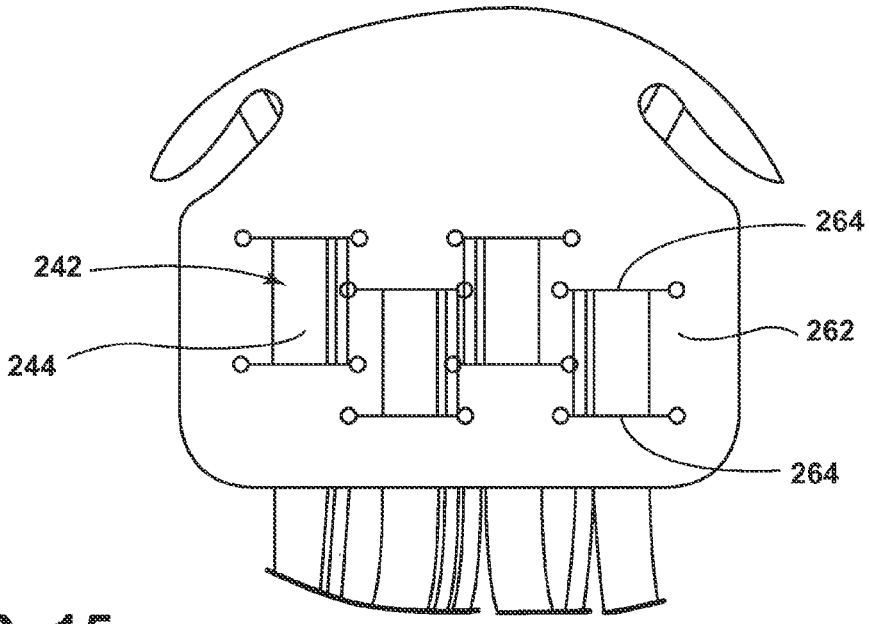
FIG. 15 is similar view to FIG. 13 but with the tubes inserted.

As best seen in FIGS. 13 and 15, flange 262 may have openings 264 through which the supply tubes may be routed or passed through and which are sized to hold the tubes in place. For example, the openings may comprise a pair of slits, which are spaced to form loops 266 (FIG. 13) between the slits so that the loops can frictionally hold the tubes in place. Optionally, each pair of tubes 242 and 244 may be supported in the same opening, such as shown in FIG. 15. Alternately, flange 262 may have openings of different sizes to support each tube separately.

Figure 14:
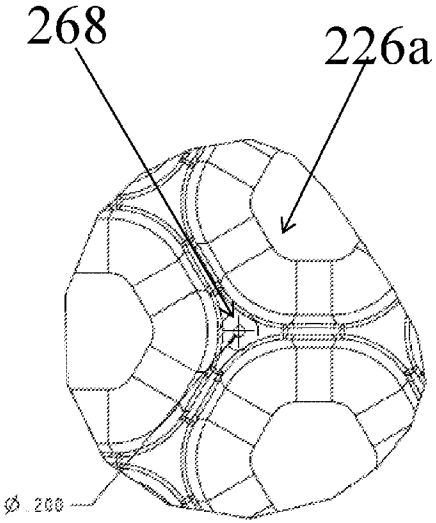
FIG. 14 is an enlarged view of detail XIV of FIG. 12.
Figure 12:
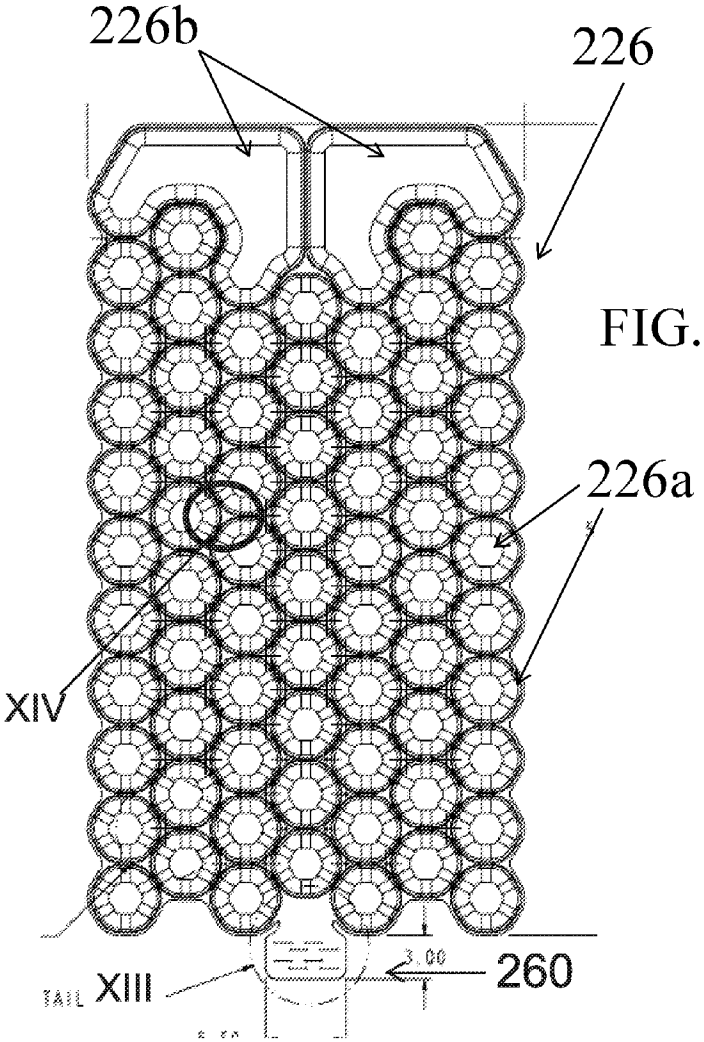
FIG. 12 is a plan view of the bladder layer of FIG. 11.

As noted above, bladder layer 226 is formed by, for example, two sheets that are joined together. The sheets may be joined around their respective perimeters and around each of the bladders or pods to form an array of discrete bladders. As noted above, at least some regions of the sheets may be left un-joined (for example see in FIG. 16) to form fluid passageways between some or all of the adjacent bladders so that a network of passageways can be formed in the bladder layer to allow air flow between at least some of the bladders, which reduces the amount of tubing that is require to inflate the bladders and to maintain the pressure in the bladders at the desired pressure value. As noted below, some bladders may be grouped together in that they are in communication with each other through the above-noted air passageways, or through tubing, so that the bladders form zones. In addition, as seen in FIG. 14, bladder layer 226 includes a plurality of transverse openings 268 located between bladders 226*a* to allow air to flow from beneath the bladder layer through the bladder layer.

Figure 8:
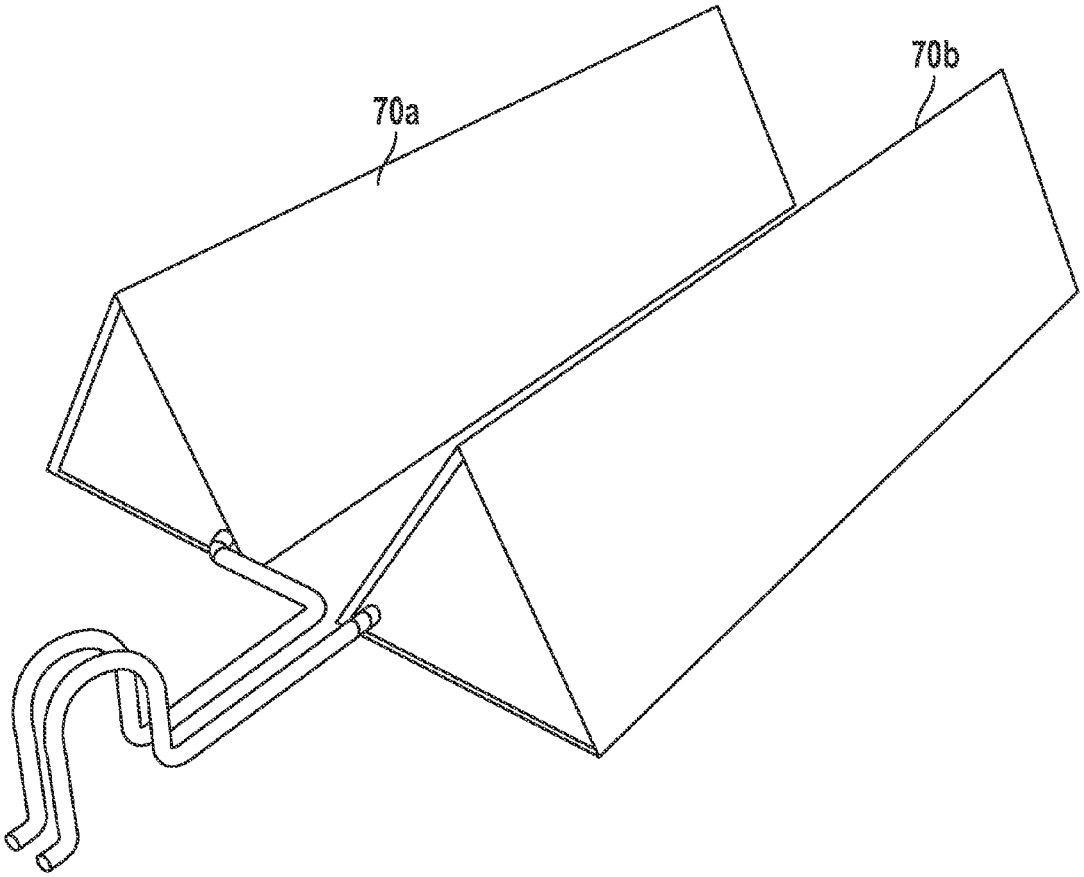
FIG. 8 is a perspective view of a pair of turning bladders.
Figure 9:
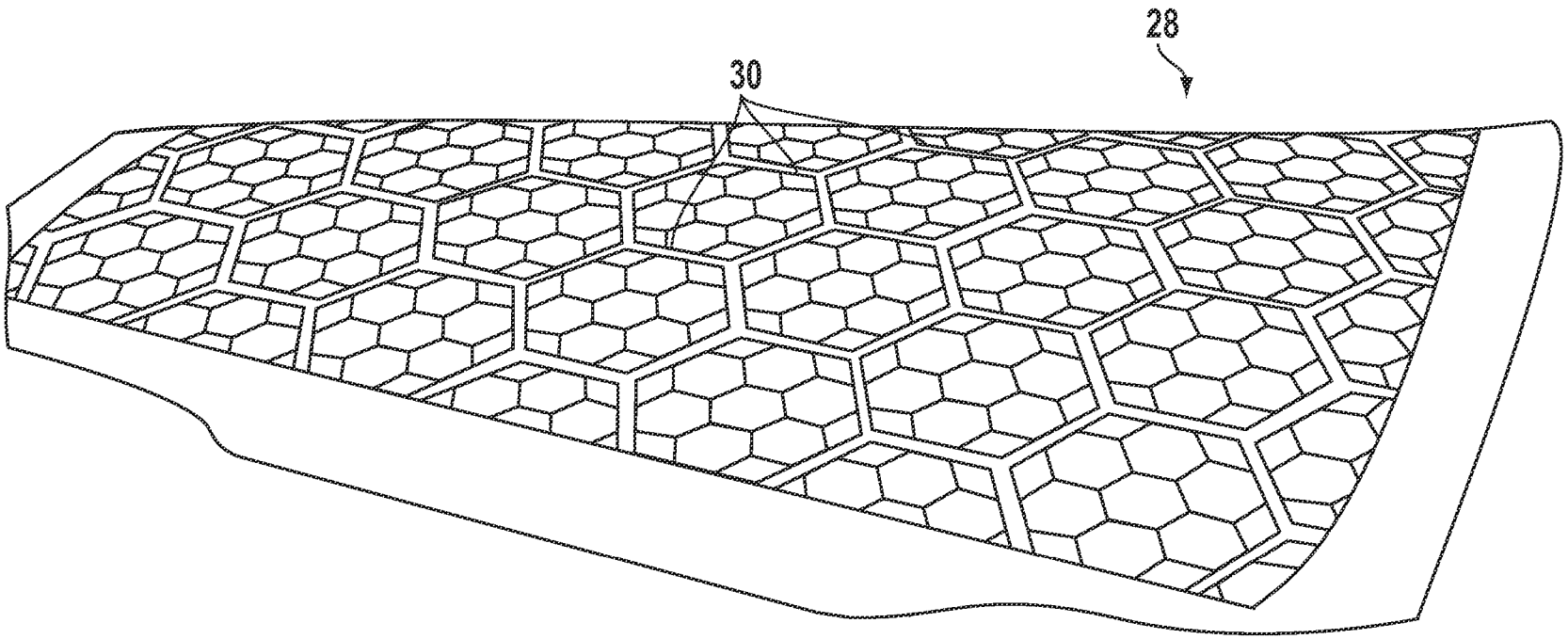
FIG. 9 is a perspective view of the gel layer of the patient support.
Figure 9A:
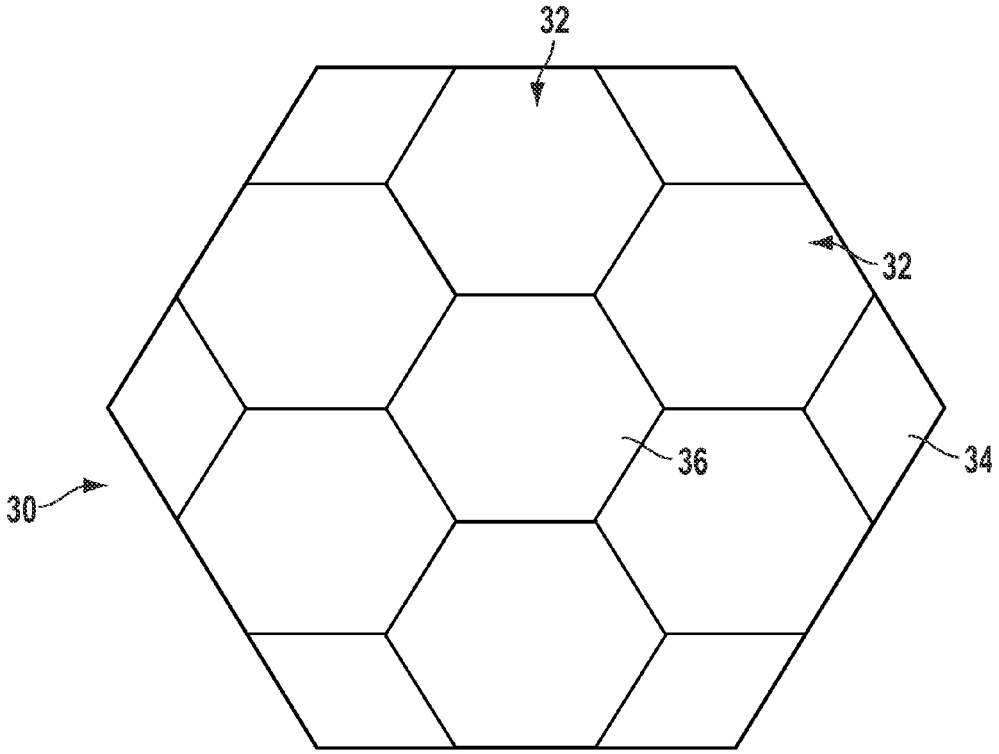
FIG. 9A is an enlarged plan view of a gel footing of the gel layer of FIG. 9.

As described above, to deliver air to bladders 226*a* and 226*b* and to the turning bladders (e.g. bladders 70*a*, 70*b* shown in FIGS. 2A and 8), support 210 includes pneumatic system 240 (FIG. 22A) with a plurality of supply tubes 242 in communication with a pneumatic supply system in the form of one or more pumps (e.g. pumps 90*a* in pump box 90 described above) and a control system with a plurality of sensing tubes 244. Supply tubes 242, as described, are harnessed by bladder layer 226 so that they can then be directed to the pump of the pneumatic supply system, described above, which may be supported in a compartment (e.g. pump box 90) at the foot end of the support beneath the gel layer and foam crib. Additionally, sensing tubes 244 may be similarly harnessed and directed to sensors, also mounted in the compartment, which sense the pressure in each zone to form part of a closed loop feedback control system, which is described more fully in U.S. patent application Ser. No. 13/836,813, entitled INFLATABLE MATTRESS AND CONTROL METHODS, filed on Mar. 15, 2013, which is incorporated by reference herein in its entirety.

When assembled, therefore, a patient support incorporating bladder layer 226 and pneumatic system 240 not only includes a cushioning layer that provides a pressure redistribution system to enhance the support of a patient lying upon the patient support but also optionally provides a line management system for the pneumatic tubes of the inflation and control system. It should be understood that the patient support may be modified to include one or more bladders in the foot zone in lieu of the gel layer and, therefore, the air pressure inside of these bladders could be monitored and controlled by the same system that controls the head and back section bladders, and the thigh and seat section bladders.

Referring to FIGS. 20-24, bladder layer 226 and a gel layer 328, similar to gel layer 28, are supported by a foam crib 340, which is of similar construction to foam crib 40 described above. Therefore, for additional details not noted herein, reference is made to foam crib 40 and gel layer 28. Crib 340 includes a head/body end 344 and a foot end 346 that are joined together at a joint 342, which is configured to allow the foot end 346 of foam crib 340 to be raised relative to the head/body end (or vice versa to allow the head/body end to be raised relative to the foot end).

Figure 22:
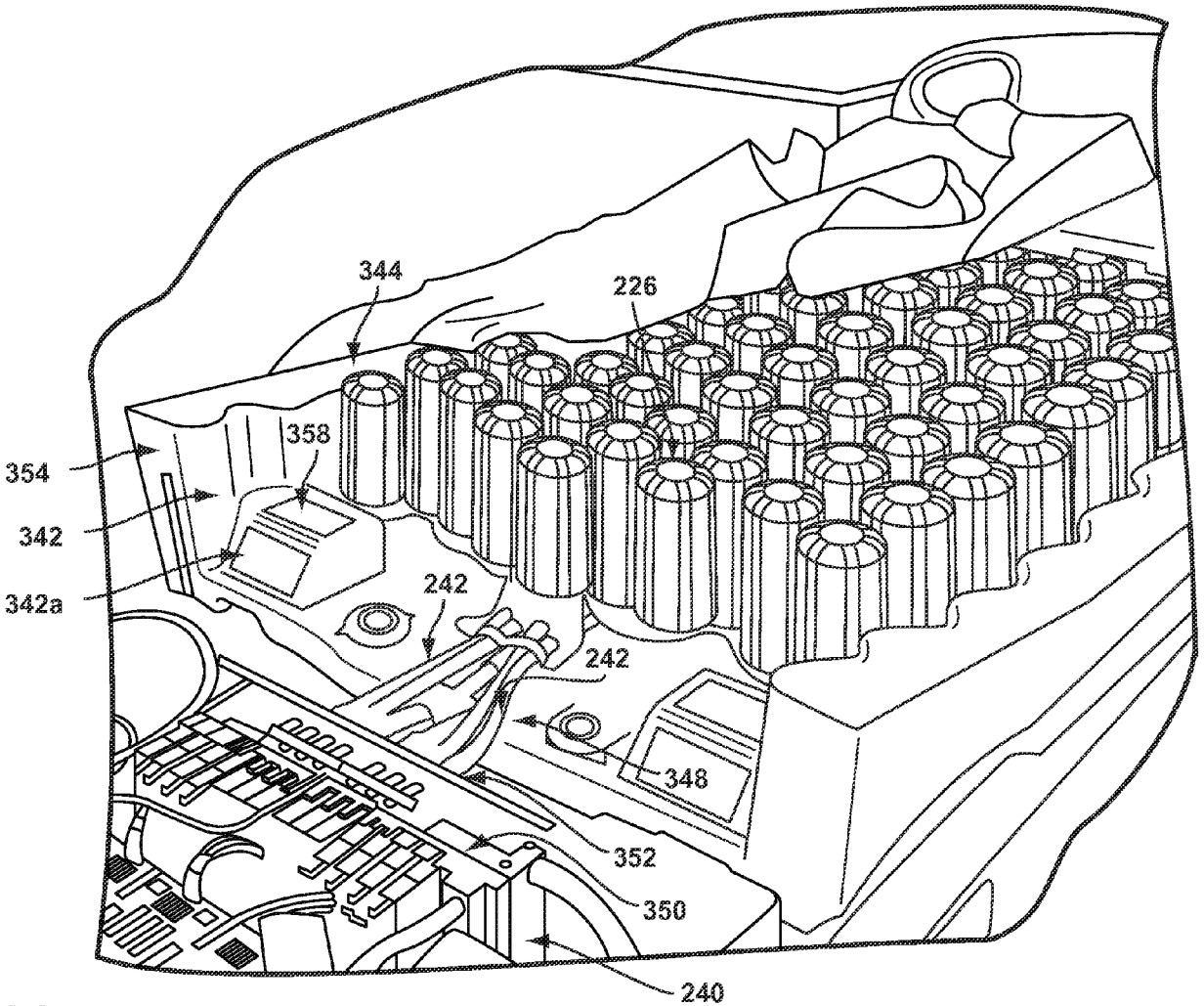
FIG. 22 is a perspective view of the portion of the foam crib that supports the bladder layer.
Figure 22A:
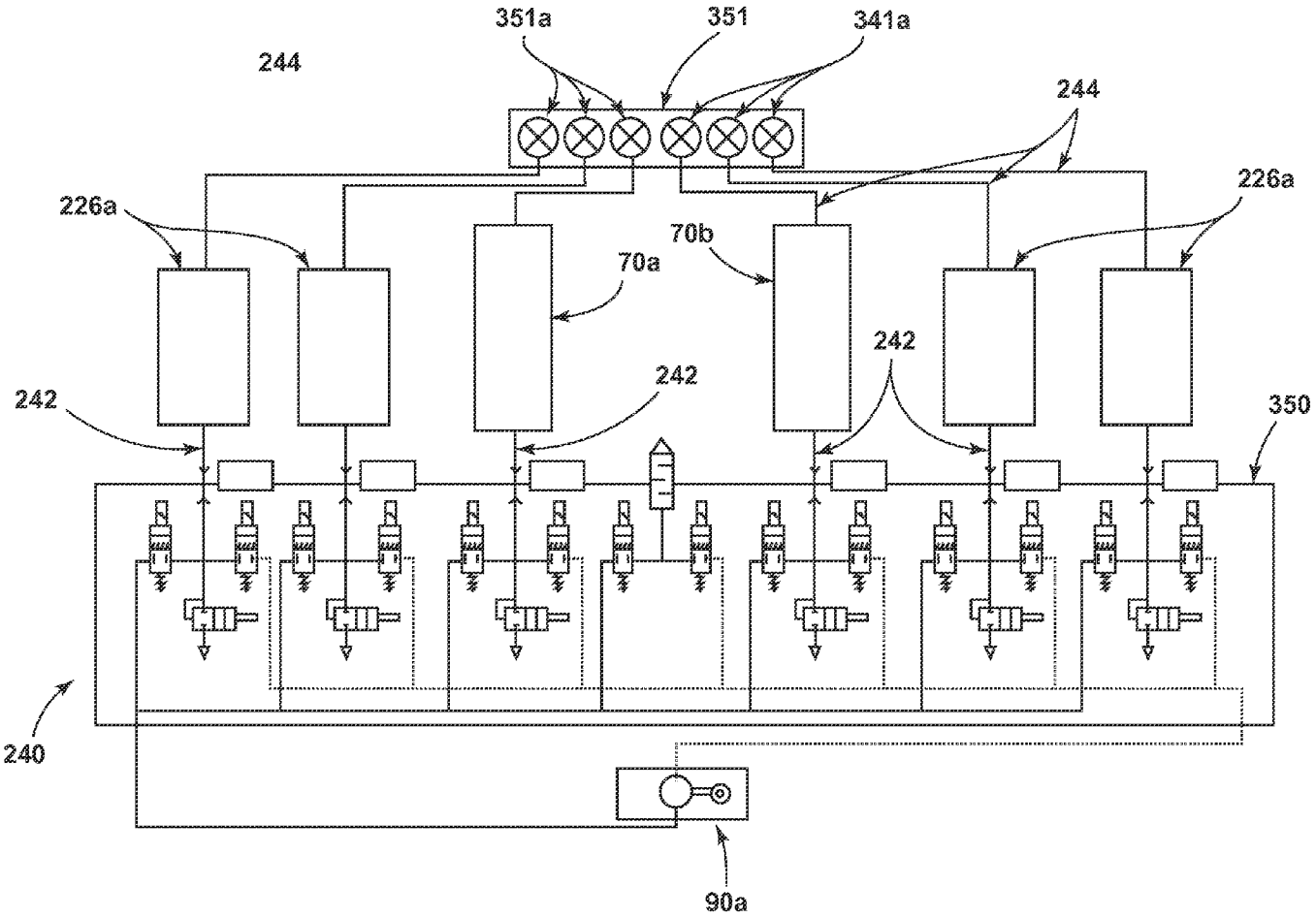
FIG. 22A is a schematic drawing illustrating the pneumatic system of the patient support.

As best seen in FIG. 22, one side of joint 342 may include a recessed region with line management channels 348 that, for example, direct supply tubing 242 from bladder layer 226 to the pneumatic supply system. As best seen in FIG. 22A, tubes or tubing 242 are in fluid communication with the respective bladders 226*a* of bladder layer 226 and with a CPR valve manifold 350 of pneumatic system 240. Sensor tubes or tubing 244 are in fluid communication with the respective bladders 226*a* of bladder layer 226 and sensors 351*a* of a sensor assembly 351, which are optionally located at the foot end in a control compartment (e.g. pump box 90) located beneath the foot end portion of the foam crib. Additionally, foam crib 340 may include channels 354 (FIG. 22) extending into its respective sides for line management purposes.

Figure 23:
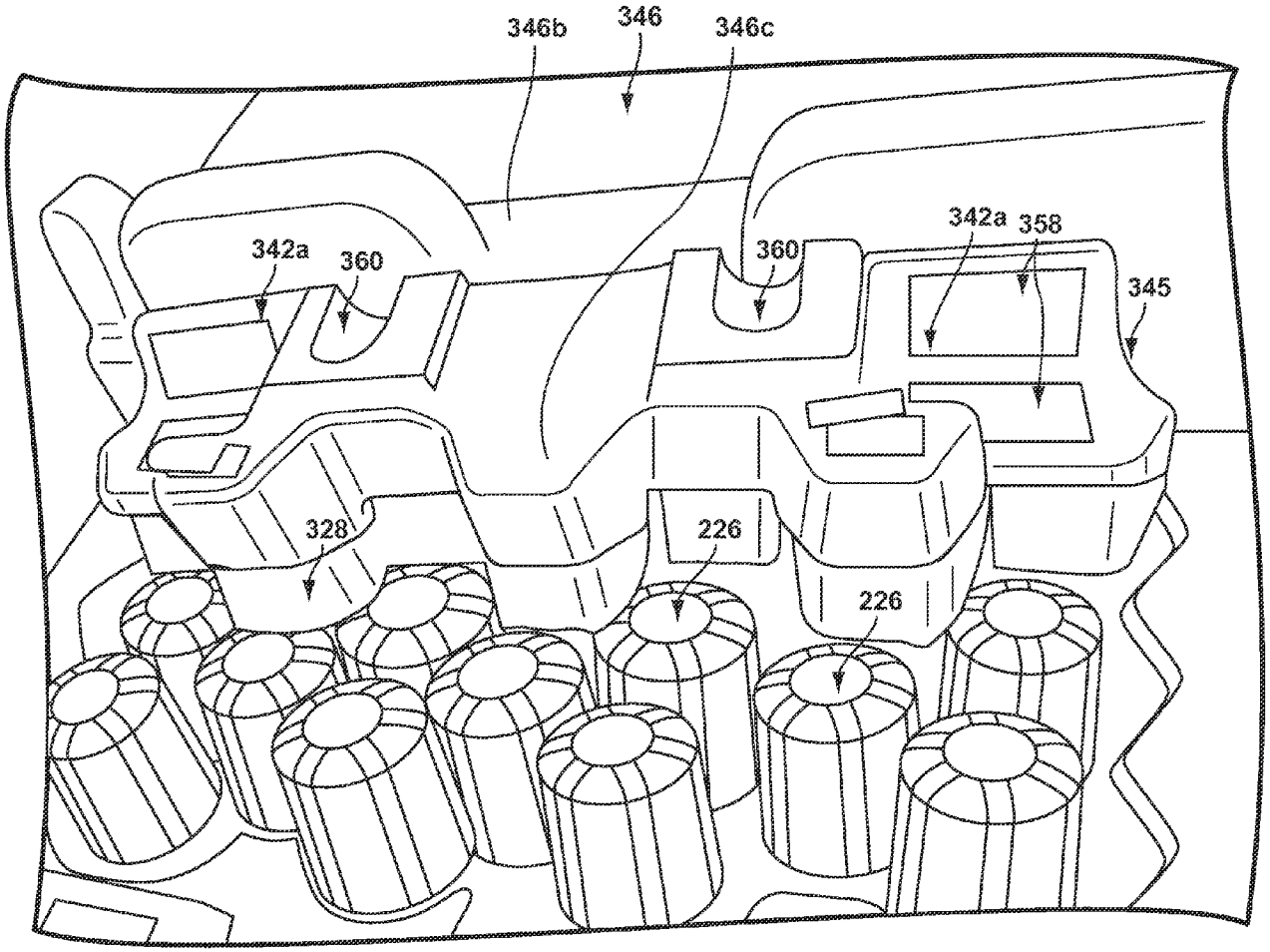
FIG. 23 is a perspective view of the portion of the foam crib that supports the gel layer inverted and placed on the bladder layer to show the connection between the foot end of the foam crib and the head/body end of the foam crib.
Figure 25:
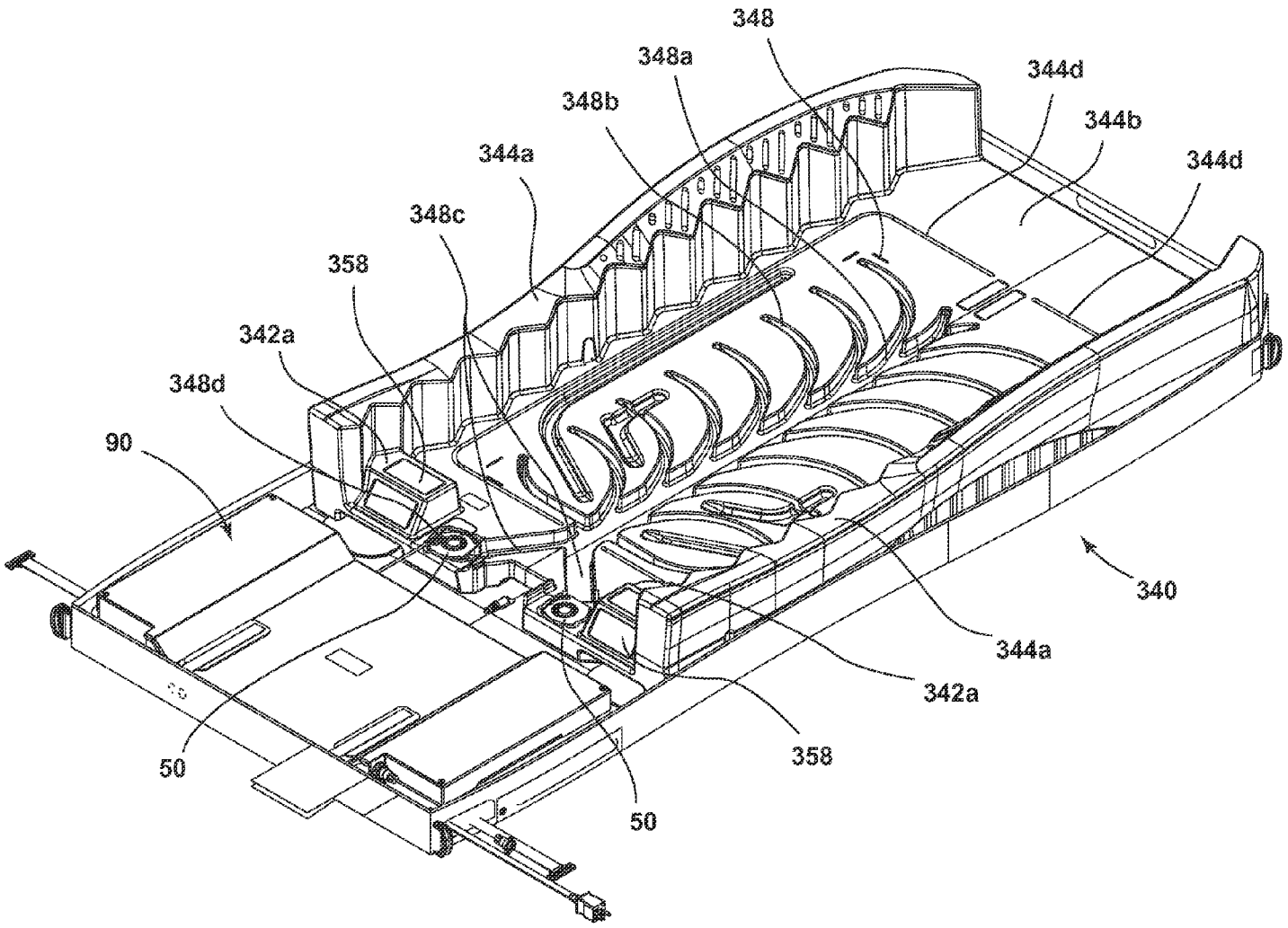
FIG. 25 is a perspective view of the foam crib of FIG. 20 with the bladder layer and gel layer removed.
Figure 26:
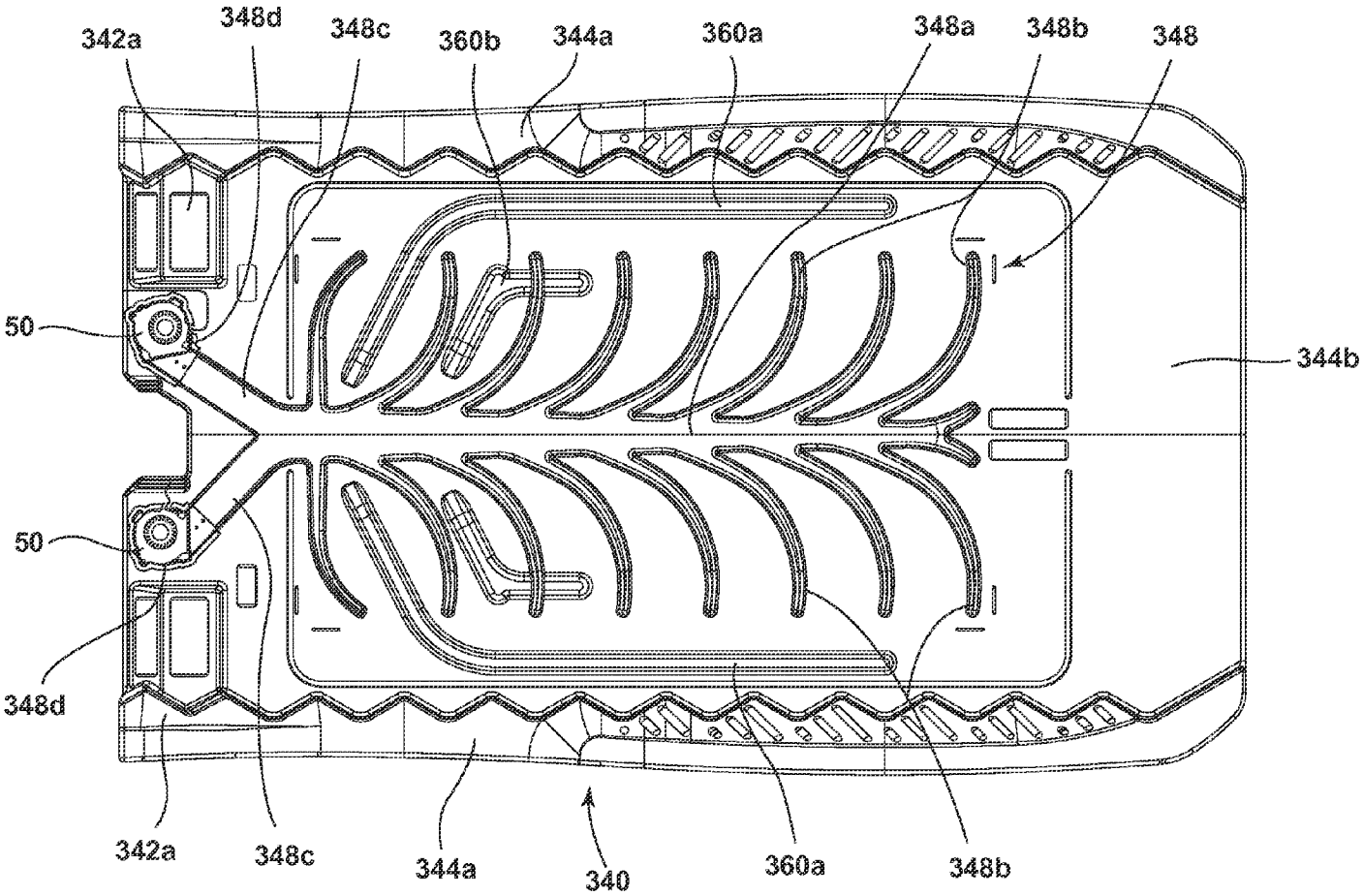
FIG. 26 is a plan view of the foam crib of FIG. 25.
Figure 27:
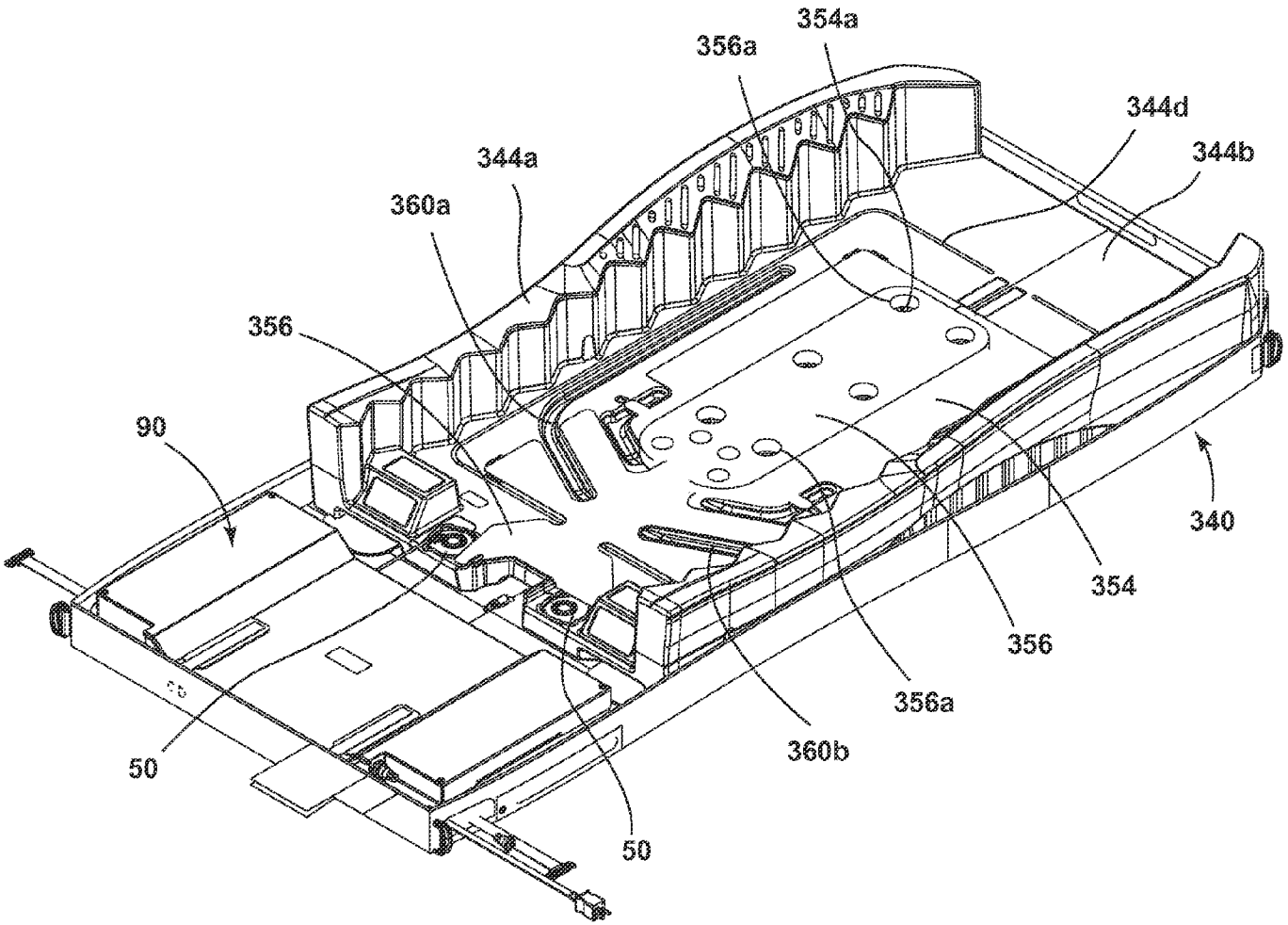
FIG. 27 is a similar view to FIG. 25 with a cover over the low air loss fluid flow channels.
Figure 28:
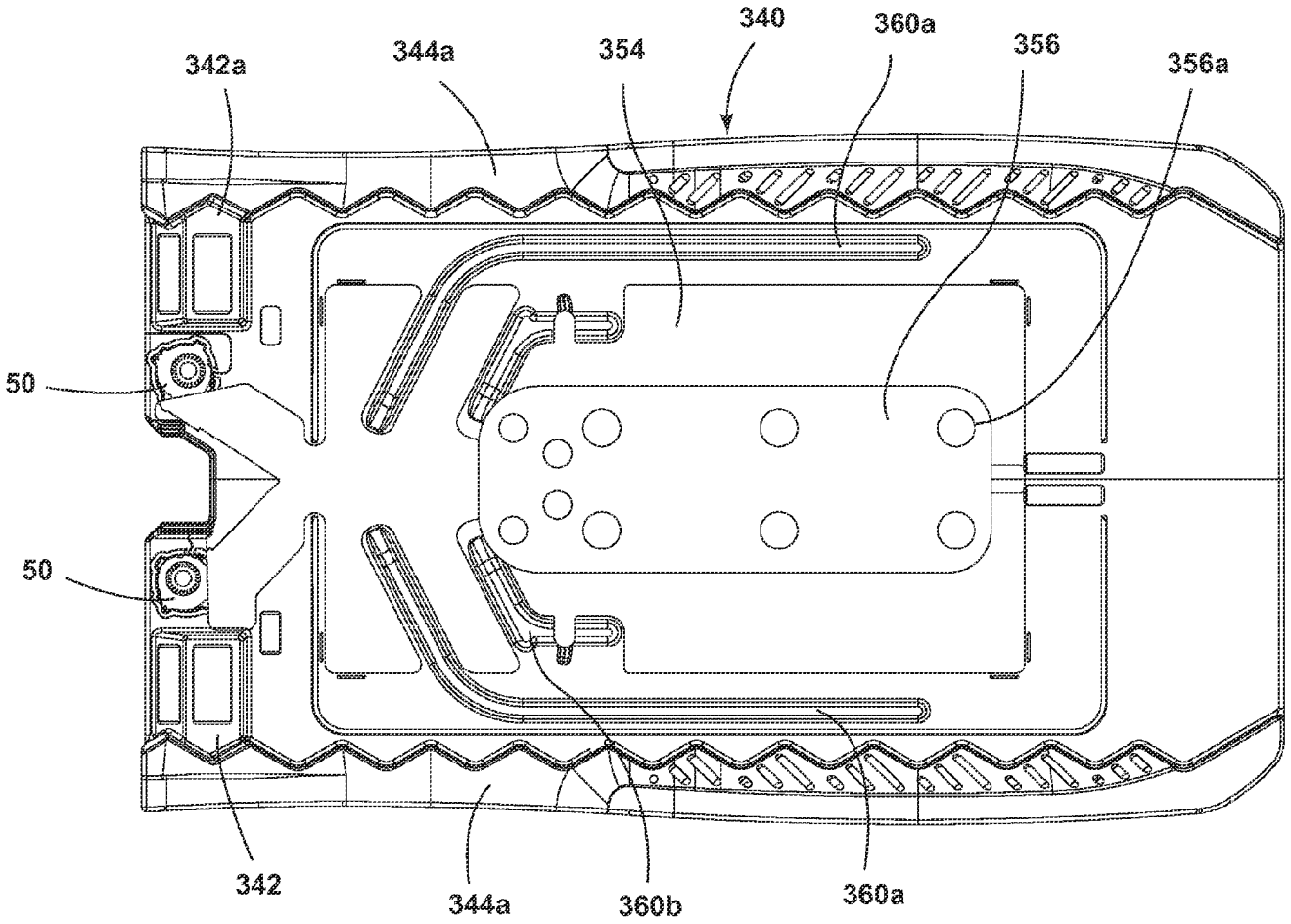
FIG. 28 is a plan view of the foam crib of FIG. 25.

Referring to FIGS. 22 and 23, joint 342 is formed by complementary stepped profiles formed by wedge shaped blocks 342*a* (FIG. 25) on the head/body end 344 of foam crib 340 and angled blocks 342*b* (FIG. 23) formed on foot end 346 of foam crib 340, which are joined by releasable fasteners, such as VELCRO patches 358 so that the foot end 346 may be disconnected from head/body end 344 to allow access to the control compartment (e.g. pump box 90). Further, when at least some of the patches are unhooked, joint 342 may form a hinge.

Figure 20:
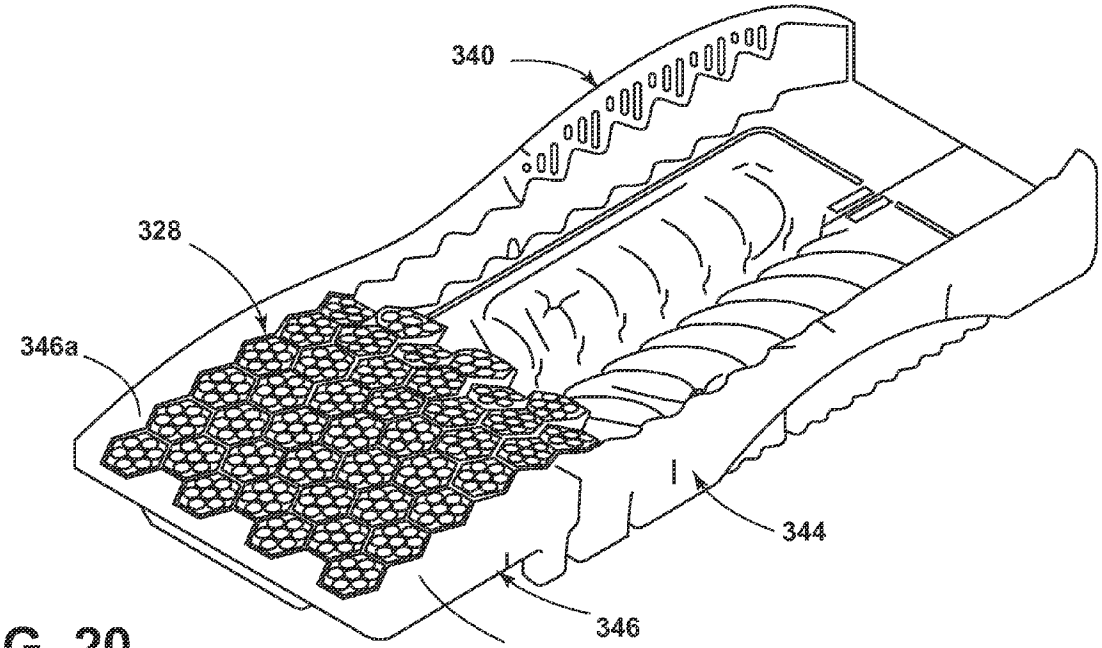
FIG. 20 is a perspective view of the foam and gel layer of the patient support.
Figure 21:
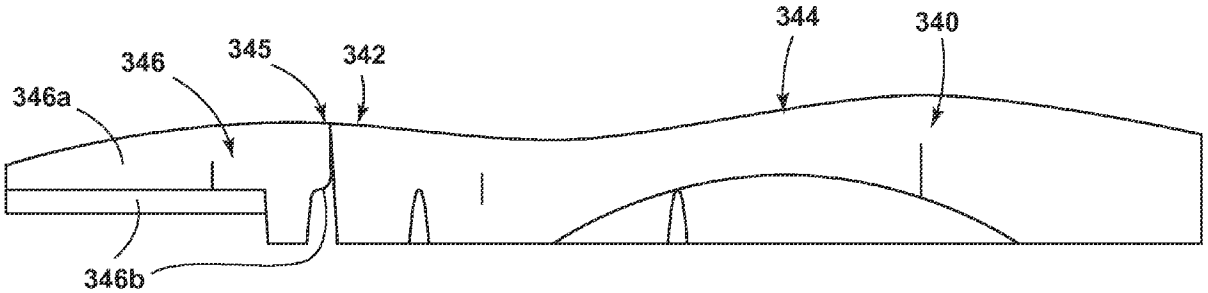
FIG. 21 is a side view of the foam and gel layer of the patient support.
Figure 24:
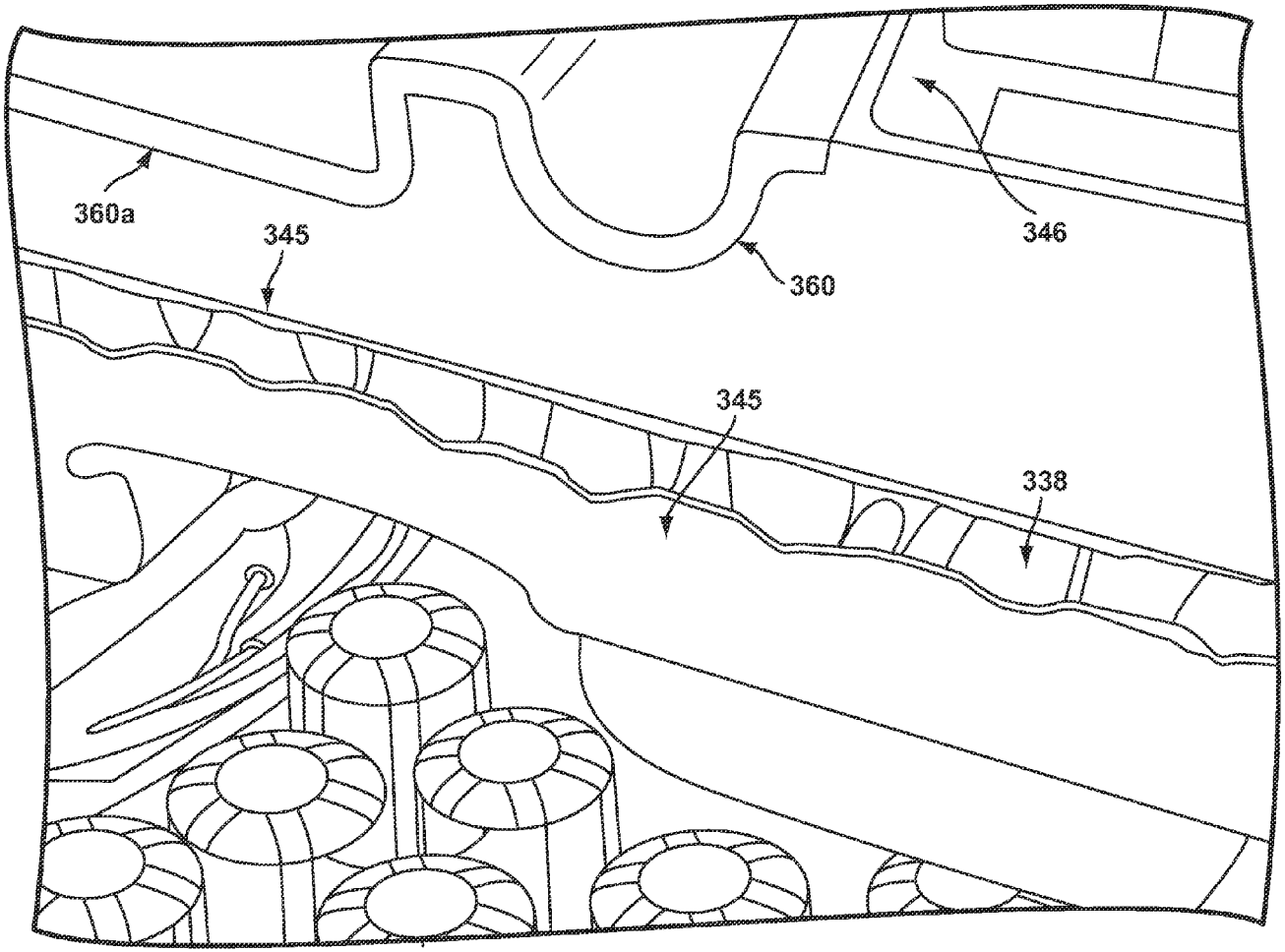
FIG. 24 is a perspective view of the foot portion of the foam crib folded showing the hinge formed by the gel layer.

As best seen from FIGS. 20, 22, and 24, the joint is formed by overlapping portions of the foot end of the crib and the head/body end of the crib. Referring to FIG. 21, foot end 346 includes a base wall 346*b* and two opposing side walls 346*a*. Side walls 346*a* generally align with the side walls 344*a* of head/body end 344 of crib 340. Base wall 346*b* extends between side walls 346*a* and includes a portion that extends beyond the ends of side walls 346*a* to form a tongue 346*c* that overlaps with the base wall 344*b* of head/body end 344 to thereby form joint 342. In this manner, the foot end of the foam crib projects beyond and into the end of the head/body end of the foam crib and further meshes with the head/body end to form joint 342. Further, tongue 346*c* supports and is joined with the gel layer, which also extends into the head/body portion so that it too meshes with the bladders of the bladder layer and is connected to the head/body end when the fasteners noted above align and are coupled.

The joint 342 further includes hinge 345, which is formed by the foot end and the head/body portion. As noted above, base wall 346*b* of foot end 346 includes a tongue 346*c* which projects into and over the base wall 344*b* of head/body end 344. Tongue 346*c* is separated and divided from the balance of base wall 346*b* to form a moving part of the hinge. Tongue 346*c* is joined to both base wall 346*b* of foot end 346 and base wall 344*b* of head/body end 344 by gel layer 328, which is adhered to base wall 346*b* of foot end and base wall 344*b* of head/body end 344 by a sheet of non-woven material and an adhesive. Gel layer 328, therefore, acts as the hinge so that foot end 346 can be pivoted about hinge 345 and then be flipped over onto the head/body end 344 (FIG. 24) to allow access to the pump box and pneumatic tubes that run from the head/body end of crib 340 to the foot end of crib 340. Further gel layer 328 may include a score line or cut (FIG. 24) that extends from its lower side into some of the walls forming the gel footing to minimize the changes of the gel wall from tearing when foot end is pivoted about tongue 346*c* and head/body end 344.

As described above, blower units 50 may be supported in the foam crib and further may be supported in recesses formed between blocks 342*a* and 342*b*. Optionally, foot end 346 of foam crib may incorporate rigid supports 360, for example, in the form of plastic flanged channels, which align over and cover the blowers to protect them from interference from the foam. Further, the channels may be joined together by a web 360*a* (see FIG. 24) so that they also provide protection to the tubing that extends through the joint from the head/body end to under the foot end of the foam crib. For further detail of gel layer 328 and crib 340, reference is made to the gel layers and foam cribs described above.

Referring now to FIG. 25-29, similar to crib 40, crib 340 may include in its base wall 344*b* a low air loss system in the form of a plurality of channels 348. Channels 348 also form a branched or tree-like configuration with a central channel 348*a* and a plurality of arcuate branch channels 348*b*, which project outwardly on either side of channel 348*a* and are in fluid communication with central channel 348*a*. Central channels 348*a* in fluid communication with inlet or feeder channels 348*c* formed at the base of central channel 348*a*. Each inlet channel 348*c* includes a recess 348*d* 46*b* for receiving a blower unit 50, whose output is directed toward the central channel 348*a* through inlet or feeder channel 348*c* and whose intake extends through the lower edge of base wall 344*b* so that when blower units 50 are covered by bladder layer 226, the blower units can draw in air from the space adjacent the lower end of foam crib 340. These channels also facilitate the bending of foam crib 340.

Blower units 50, when operated, blow air into channels 348*c* and 348*a*, which in turn distribute the air into branch channels 348*b* to generate air flow into the bladder layer 226 from beneath. To allow the air to flow through bladder layer 226, the base sheet of bladder layer 226, as noted above, includes a plurality of openings 268 so that air can flow up through the bladder layer 226 and between the bladders 226*a*. To better focus the flow of air, base layer 344*b* may incorporate a sheet of non-woven material 354, such as nylon (FIGS. 27 and 28), adhered to its upper surface, which extends over inlet channels 348*c*, central channel 348*a*, and over the entire length branch channels 348*b*.

To direct air flow form the channels to beneath the bladder layer, sheet 354 includes a plurality of openings 354*a* that direct the air flow from the channels to discrete and clustered locations at the underside of bladder layer 226. To accommodate variations in the surface topology of the underside of bladder layer 226, a second sheet or panel 356 of resilient material overlies the region of sheet 354 with openings 354*a*, which includes also openings 356*a* that align with openings 354*a*.

Sheet 356 is formed from a resilient material so that it can absorb the variations due to the uneven surface topology of the underside of the bladder layer. For example, a suitable material includes a foam or a structural gel. Sheet 356 may have a thickness, for example, in range of ⅛" to 2 inches or ¼" to 1.5 inches or ½" to 1.0 inch. The width of sheet 356 may be in range of 2 to 35 inches (in other words the full width of the mattress). The length of sheet 356 may be in range of 15 to 80 inches (in other words the length width of the mattress). As a result, sheet 356 effectively seals the openings on sheet 354 against the underside of the bladder layer 226 to thereby form a gasket. Further, the openings 268 in bladder layer 226 may also be centralized so that the air flow can be more effectively distributed through the bladder layer, thereby possibly reducing air loss between the bladder layer and the channels.

Similar to crib 40, crib 340 may also have cutouts 344*d* through its base wall 344*b* to form panels that can be raised by, for example, turning bladders, such as turning bladders 70*a* and 70*b*, to be located under the crib to lift and turn one side of the bladders to turn a patient support thereon. In addition to channels 348*a-d*, base wall 344*b* may include line management channels 360*a* and 360*b*, which may further facilitate to keep the tubes in their proper alignment with the bladder layer. Additionally, line management channels 360*a* and 360*b* facilitate a closer fit between bladder layer 226 and the base wall of the foam crib to further reduce potential air loss leakage from the low air loss system.

Figure 10:
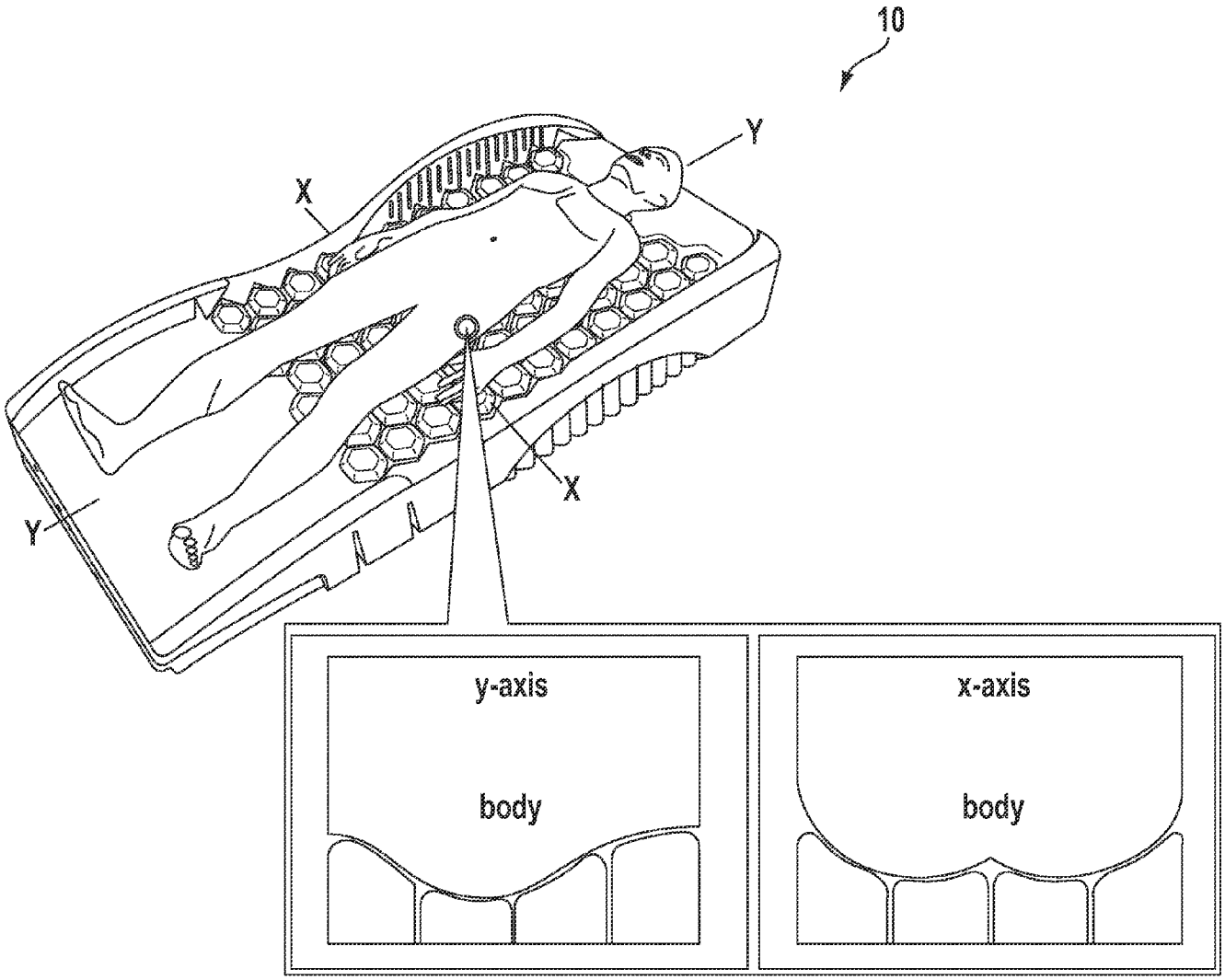
FIG. 10 is a similar view to FIG. 3 illustrating a patient supported on the surface and illustrating the immersion of the patient's body into the surface.

Accordingly, the present invention provides a patient support that provides a mattress with inflatable support bladders that offer improved immersion of the patient into the surface of the mattress and, therefore, improved pressure distribution to the patient. With the independent discrete bladder arrangement, it has been found that a more balanced contact (see FIG. 10) can be achieve in both the x and y-axes. Further, given the unitary nature of the support bladders, the need for tubing can be significantly reduced, and for some functions eliminated. Further, the present invention provides a patient support that provides a mattress with inflatable support bladders that can offer improved immersion in combination with a line management system that facilitates assembly and handling of the patient support.

While several forms of the invention have been shown and described, other changes and modifications will be appreciated by those skilled in the relevant art. Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

We claim:

1. A patient support, comprising:

a bladder layer with a plurality of bladders;

a pneumatic supply system; and a plurality of tubes in fluid communication with the pneumatic supply system and the bladder layer, the tubes coupled to and guided by a lower sheet forming the bladders of the bladder layer, the bladder layer including a harness for harnessing and holding the tubes, wherein the harness comprises a flange with a plurality of openings there through to thereby hold the tubes in the flange, wherein the bladder layer comprises an upper sheet, and the flange comprises a portion of the lower sheet.

2. The support of claim 1, wherein the tubes comprise supply tubes.

3. The support of claim 1, wherein the tubes comprise sensing tubes.

4. The support of claim 1, wherein the tubes comprise sensing tubes and supply tubes.

5. The support of claim 1, wherein the bladder layer includes a plurality of supports, the supports comprising channels.

6. The support of claim 5, wherein the supports are formed from patches of sheet material attached at or to the lower sheet of the bladder layer.

7. The support of claim 1, wherein the bladder layer includes at least two zones, with each zone being configured to be separately inflatable.

8. The support of claim 1, wherein the openings comprise slits.

9. The support of claim 1, wherein the bladder layer includes an array of bladders and a plurality of transverse openings allowing air to pass through the bladder layer to direct air flow through the bladder layer.

10. The support of claim 1, wherein each of said bladders has a hexagonal cross-section.

11. The patient support according to claim 1, further comprising:

a foam crib having first and second sections, said foam crib supporting said bladder layer; and a gel cushioning layer forming a cushion surface for a patient and having a plurality of gel walls configured to buckle under the weight of a patient, said gel cushioning layer supported on the foam crib and joined to the two sections of the foam crib, and the gel-cushioning layer forming a hinge for the two sections of the foam crib.

12. The support of claim 11, wherein the first section comprises a head/body end and the second section comprises a foot end, the gel cushioning layer forming a hinge between the foot end and the head/body end, and the head/body end supporting said bladder layer.

13. The support of claim 12, wherein the foot end is releasably coupled to the head/body end.

14. The support of claim 13, wherein the foot end is releasably coupled to the head/body end by hook and loop strips.

15. The support of claim 12, wherein the foot end is releasably coupled to the head/body end by a joint, the joint forming line management channels.

16. A patient support comprising:

a bladder layer with a plurality of bladders;

a pneumatic supply system; and a plurality of tubes in fluid communication with the pneumatic supply system and the bladder layer, the bladder layer including a sheet forming the bladders, the sheet including a harness holding and harnessing the tubes, and the harness including a flange with a plurality of openings there through to thereby hold the tubes in the harness, wherein the sheet comprises a lower sheet joined with an upper sheet, and the flange being formed by a portion of the lower sheet.

17. The support of claim 16, wherein the openings comprise slits.

18. The patient support of claim 16, further comprising:

a blower unit having an output;

a foam crib supporting the bladder layer, the foam crib having recesses formed therein to form channels and in fluid communication with the output of the blower; and a cover extending over the recesses to cover the recesses, the cover having openings for directing air flow from the channels to the underside of the bladder layer.

19. The support of claim 18, wherein said bladder layer has a plurality of openings therethrough to allow air flow from the channels to pass through the bladder layer.

20. The support of claim 18, wherein the cover is adapted to seal against the underside of the bladder layer to reduce air loss between the bladder layer and the channels.

21. The support of claim 20, wherein the cover supports a resilient pad, the pad including openings aligning with the openings of the cover.

* * * * *